US010140814B2

(12) United States Patent
Anderson et al.

(10) Patent No.: US 10,140,814 B2
(45) Date of Patent: Nov. 27, 2018

(54) MOBILE PAYMENT AND CREDIT INTEGRATION INTO A WAGERING GAME MACHINE

(75) Inventors: Peter R. Anderson, Glenview, IL (US); Dale R. Buchholz, Palatine, IL (US); Mark B. Gagner, West Chicago, IL (US); Damon E. Gura, Chicago, IL (US); Alfred Thomas, Las Vegas, NV (US); Matthew J. Ward, Northbrook, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 461 days.

(21) Appl. No.: 13/361,984

(22) Filed: Jan. 31, 2012

(65) Prior Publication Data

US 2013/0130778 A1 May 23, 2013

Related U.S. Application Data

(60) Provisional application No. 61/437,998, filed on Jan. 31, 2011.

(51) Int. Cl.
*A63F 9/24* (2006.01)
*G07F 17/32* (2006.01)

(52) U.S. Cl.
CPC ..... *G07F 17/3251* (2013.01); *G07F 17/3223* (2013.01); *G07F 17/3244* (2013.01); *G07F 17/3246* (2013.01)

(58) Field of Classification Search
CPC ..... G07F 17/3248; G07F 17/3225; G07F 17/3244; G07F 17/3251
(Continued)

(56) References Cited

U.S. PATENT DOCUMENTS 6,110,041 A 8/2000 Walker et al.
6,293,866 B1 9/2001 Walker et al.
(Continued)

FOREIGN PATENT DOCUMENTS

WO WO2004025583 3/2004
WO WO2005027059 3/2005
(Continued)

OTHER PUBLICATIONS

"U.S. Appl. No. 12/895,783 Final Office Action", dated Nov. 2, 2012 , 23 pages.
(Continued)

*Primary Examiner* — Lawrence Galka
(74) *Attorney, Agent, or Firm* — DeLizio Law, PLLC

(57) ABSTRACT

A wagering game machine includes a processor and a wagering game module, executable on the processor, configured to present a wagering game on which monetary value can be wagered to a wagering game player. The machine includes a receiver configured to communicate with a transmitter of a mobile device to receive a mobile payment from the mobile device. The machine includes a bill validator that is communicatively coupled to the receiver. The bill validator configured to receive the mobile payment from the receiver, wherein the bill validator is configured to output a first communication to issue a first wagering game credit for the wagering game machine in response to receipt of a monetary bill, wherein in response to receipt of the mobile payment from the receiver the bill validator is configured to output a second communication to issue a second wagering game credit on the wagering game machine.

15 Claims, 11 Drawing Sheets

(58) Field of Classification Search
USPC ..... 463/25
See application file for complete search history.

(56) References Cited

U.S. PATENT DOCUMENTS

| | | | | |
|---|---|---|---|---|
| 6,848,996 | B2 | 2/2005 | Hecht et al. | |
| 6,878,067 | B2 | 4/2005 | Blanco | |
| 6,902,481 | B2 | 6/2005 | Breckner et al. | |
| 7,033,276 | B2 | 4/2006 | Walker et al. | |
| 7,040,987 | B2 | 5/2006 | Walker et al. | |
| 7,355,112 | B2 | 4/2008 | Laakso et al. | |
| 7,364,508 | B2 | 4/2008 | Loose et al. | |
| 7,367,886 | B2 | 5/2008 | Loose et al. | |
| 7,479,063 | B2 | 1/2009 | Pryzby et al. | |
| 7,789,748 | B2 | 9/2010 | Landrum et al. | |
| 8,317,624 | B1 | 11/2012 | Lam | |
| 2002/0025850 | A1* | 2/2002 | Hafezi | G07F 17/3202 463/29 |
| 2002/0142825 | A1 | 10/2002 | Lark et al. | |
| 2002/0155887 | A1* | 10/2002 | Criss-Puszkiewicz | G07F 17/32 463/29 |
| 2002/0165023 | A1* | 11/2002 | Brosnan | G07F 17/32 463/29 |
| 2003/0073489 | A1 | 4/2003 | Hecht et al. | |
| 2003/0100355 | A1 | 5/2003 | Hannay | |
| 2003/0100359 | A1 | 5/2003 | Loose et al. | |
| 2004/0142747 | A1 | 7/2004 | Pryzby | |
| 2005/0043090 | A1 | 2/2005 | Pryzby et al. | |
| 2005/0059482 | A1* | 3/2005 | Hedrick | G07F 17/32 463/29 |
| 2005/0060759 | A1 | 3/2005 | Rowe et al. | |
| 2005/0064935 | A1 | 3/2005 | Blanco | |
| 2005/0159218 | A1 | 7/2005 | Blanco | |
| 2005/0277469 | A1 | 12/2005 | Pryzby et al. | |
| 2006/0009285 | A1 | 1/2006 | Pryzby et al. | |
| 2006/0049624 | A1* | 3/2006 | Brosnan | G07F 17/3248 283/17 |
| 2006/0068909 | A1 | 3/2006 | Pryzby et al. | |
| 2006/0160621 | A1* | 7/2006 | Rowe | G07F 17/32 463/42 |
| 2006/0252523 | A1 | 11/2006 | Walker et al. | |
| 2007/0015570 | A1 | 1/2007 | Pryzby | |
| 2007/0027803 | A1* | 2/2007 | Brandes | G06Q 20/04 705/39 |
| 2007/0060302 | A1* | 3/2007 | Fabbri | G07F 17/323 463/24 |
| 2007/0135213 | A1 | 6/2007 | Walker et al. | |
| 2007/0174490 | A1 | 7/2007 | Choi et al. | |
| 2007/0233494 | A1 | 10/2007 | Shen et al. | |
| 2008/0058059 | A1* | 3/2008 | Fitzsimons | G07F 17/32 463/20 |
| 2008/0064486 | A1 | 3/2008 | Pryzby et al. | |
| 2008/0076548 | A1 | 3/2008 | Paulsen | |
| 2008/0090659 | A1 | 4/2008 | Aguilar et al. | |
| 2008/0096666 | A1 | 4/2008 | Pryzby et al. | |
| 2008/0139284 | A1 | 6/2008 | Pryzby et al. | |
| 2008/0176654 | A1 | 7/2008 | Loose et al. | |
| 2009/0029775 | A1* | 1/2009 | Ruppert | H04L 67/06 463/42 |
| 2009/0131155 | A1* | 5/2009 | Hollibaugh | G07F 17/3248 463/25 |
| 2009/0171995 | A1 | 7/2009 | Silvester et al. | |
| 2009/0221342 | A1* | 9/2009 | Katz | G07F 17/3276 463/17 |
| 2009/0325714 | A1 | 12/2009 | Kelly et al. | |
| 2009/0325715 | A1 | 12/2009 | Kelly et al. | |
| 2010/0016068 | A1* | 1/2010 | White | G06Q 40/02 463/25 |
| 2010/0093425 | A1 | 4/2010 | Tsuchiya et al. | |
| 2010/0094752 | A1* | 4/2010 | Heath | G06Q 20/102 705/40 |
| 2010/0120532 | A1 | 5/2010 | Bracken et al. | |
| 2010/0120533 | A1 | 5/2010 | Bracken et al. | |
| 2010/0227670 | A1* | 9/2010 | Arezina | G07F 17/32 463/25 |
| 2011/0092288 | A1 | 4/2011 | Pryzby et al. | |
| 2012/0078735 | A1* | 3/2012 | Bauer | G06Q 20/20 705/16 |
| 2012/0122565 | A1* | 5/2012 | Mishra | G07F 17/32 463/25 |
| 2012/0122585 | A1* | 5/2012 | Nguyen | 463/42 |
| 2012/0142403 | A1* | 6/2012 | Prather | G06Q 20/10 463/13 |
| 2012/0258798 | A1 | 10/2012 | Cullen et al. | |
| 2013/0065686 | A1* | 3/2013 | LeMay et al. | 463/37 |

FOREIGN PATENT DOCUMENTS

| | | |
|---|---|---|
| WO | WO2008057538 | 5/2008 |
| WO | WO02008066686 | 6/2008 |
| WO | WO2009009269 | 1/2009 |

OTHER PUBLICATIONS

"U.S. Appl. No. 12/895,783 Office Action", dated Jul. 13, 2012 , 19 pages.
"U.S. Appl. No. 13/948,997 Office Action", dated Oct. 3, 2014, 16 Pages.
"U.S. Appl. No. 13/948,997 Final Office Action", dated Dec. 22, 2014, 18 Pages.

* cited by examiner

MOBILE PAYMENT AND CREDIT INTEGRATION INTO A WAGERING GAME MACHINE

RELATED APPLICATIONS

This application claims the priority benefit of U.S. Provisional Application Ser. No. 61/437,998 filed Jan. 31, 2011.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to wagering game systems having mobile payment integration.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. Additionally, current methods for players inputting monies into a wagering game machine include the insertion of monetary bills/coins or a printed ticket with a bar code representing a monetary value, player card with a magnetic strip having data representing a monetary value, etc.

BRIEF DESCRIPTION OF THE FIGURES

Embodiments of the invention are illustrated in the Figures of the accompanying drawings in which.

DESCRIPTION OF THE EMBODIMENTS

Figure 1:
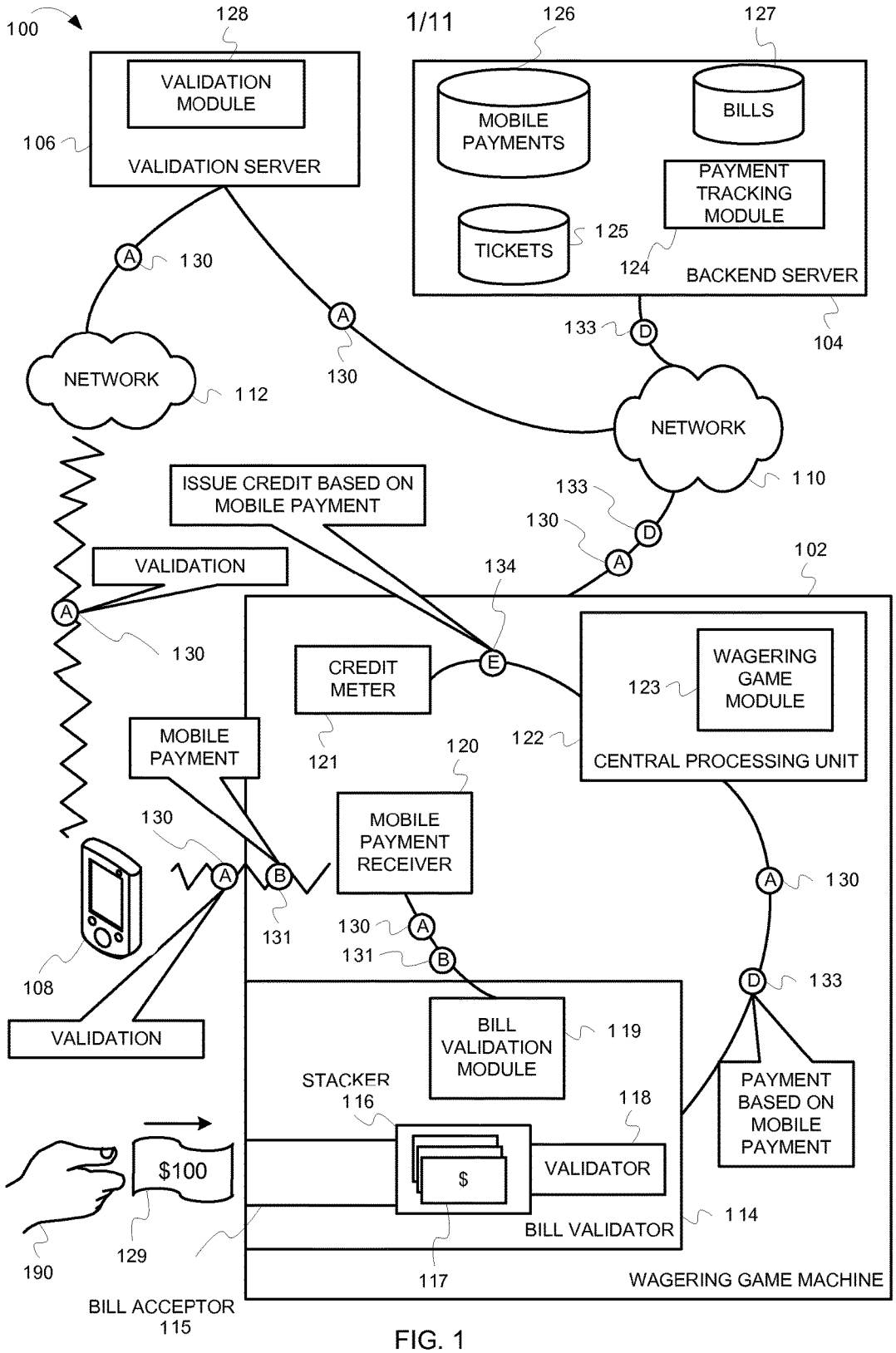
FIG. 1 depicts a wagering game system with a wagering game machine having mobile payment integration for receiving mobile payments for wagering game play, according to some example embodiments.

This description of the embodiments is divided into seven sections. The first section provides an introduction to some example embodiments, while the second section describes example system environments. The third section describes example operations performed by some example embodiments. The fourth section describes a wagering game machine architecture, and the fifth section describes a wagering game network. The sixth section describes an example wagering game machine and the seventh section presents some general comments.

Introduction

This section provides an introduction to some example embodiments. Some example embodiments can incorporate mobile payments and credits into existing wagering game machines with a limited amount of changes (e.g., hardware and software) being made. Accordingly, this mobile payment technology can be incorporated into any of a number of different wagering game machines that are already in the field based on some minor modifications (as further described below).

The nature of casino gaming requires that players pay before they play. The funding of game play has changed over the years, from actual coins, to tokens, to bills, to tickets and to account-based wagering. Wagering game players have shown they are willing to change behavior in exchange for convenience.

Current funding methods generally require multiple steps during a gaming session. For example, the player may be required to 1) leave the wagering game machine, 2) walk to an Automated Teller Machine (ATM) or some other cash dispensing device, 3) withdraw money, and 4) convert the money into game credits one bill at a time. One approach to these multiple steps has been to move to account-based wagering. However, even account-based wagering requires funds be transferred into a special account before logging onto a wagering game. Subsequently, these transferred funds are converted into game credits for wagering game play.

Another approach may be to allow direct access to bank accounts from wagering game machines. However, research has shown that players have a great concern about having direct access to extended funds while gaming. When asked about accessing bank accounts from a wagering game machine, players voice fears about transferring too much cash during the heat of a gaming session. Another approach has been to provide funding with a credit card. Aside from the fact that fewer people have credit cards than have bank accounts, many players fear the interest or fees involved with credit cards.

Some example embodiments integrate mobile payments and credits into a wagering game machine. Mobile payments and credits using a mobile device (e.g., smart phone) offer a unique opportunity for funding wagering game machines. Specifically, mobile payments offer the speed and ease of account-based solutions, while providing an added psychological division between the wagering game machine and the player's extended funds. In particular, a player is still required to provide some interaction with the mobile device prior to the transfer of funds (as further described below).

Some example embodiments incorporate mobile payments and credits into existing wagering game machines with a limited amount of hardware and software added thereto. In some example embodiments, a communication receiver (e.g., wireless) is added into a wagering game machine. This communication receiver is communicatively coupled to a bill validator within a typical wagering game machine configuration. In operation, this communication receiver can receive mobile payments from a mobile device. The signals from the mobile device regarding the mobile payments can be either wired or wireless communications. Also, various protocols and communications standards can be used for this communication (e.g., Bluetooth, wireless Local Area Network (LAN), Near Field Communication (NFC), Universal Serial Bus (USB), etc.). In some example embodiments, the mobile device can store an electronic wallet having mobile cash therein.

The communication receiver can then forward a signal to the bill validator that indicates that a mobile payment has been received. This signal can be a spoofed signal that causes the bill validator to assume that it has received an actual monetary bill or printed ticket physically provided by a wagering game player. This spoofed signal causes an actual hard count of the monetary bills or tickets to be incorrect. However, this incorrection in the hard count can be rectified by accounting for the mobile payments.

Some example embodiment incorporate mobile credits into wagering game machines to enable a player to cash out from a wagering game machine, such that the cash is returned to a player's account associated with their mobile device. In some of these configurations, a transmitter is communicatively coupled to an existing cash out device in the wagering game machine. This transmitter can communicate with a player's mobile device to transfer cash from the wagering game machine to the player's account associated with the mobile device. In some example embodiments, the existing cash out device can include a ticket printer that issues a ticket having a bar code that represents the amount of cash that was cashed out from the wagering game machine. Such ticket can be placed into another wagering game machine for game credit, cashed out by a machine or personnel at the wagering game establishment, etc. In some example embodiments, instead of issuing a printed ticket through the ticket printer, the ticket printer transmits a cash-out signal to the transmitter. The transmitter can then communicate with the player's mobile device to transfer the cash from the wagering game machine to the player's mobile device. Similar to the receipt of mobile payments, limited changes (to hardware and software) can occur to existing wagering game machines to enable the transfer of cash out from the wagering game machine to the mobile device. In particular in some example embodiments, the existing hardware of a wagering game machine is not modified beyond the addition of a transmitter communicatively coupled to the cash out device (e.g., ticket printer) (and the associated coupling of the transmitter to the existing hardware).

Accordingly in some example embodiments, the existing hardware of a wagering game machine is not modified beyond the addition of a receiver communicatively coupled to the bill validator and/or a transmitter communicatively coupled to the ticket printer (and the associated coupling of the receiver and possible transmitter to the existing hardware). Therefore, this mobile payment integration can be added to current wagering game machines in the field by introducing the new receiver and/or transmitter. Accordingly, some example embodiments provide a low cost approach to introducing mobile payments into legacy wagering game machines.

In some example embodiments, the current protocols for communications regarding the payments from the players can be used, thereby not requiring a new protocol for mobile payments and credits. For example, the communications between the wagering game machine and a backend server can be based on Slot Accounting System (SAS), Game To System (G2S), etc. A current field in the protocol can be used to identify the mobile payments or credits. Alternatively or in addition, fields can be added into these protocols to indicate that mobile payments or credits.

In some example embodiments, the mobile device can present a bar code on its screen, wherein the bar code represents a monetary value. The wagering game machine can include a bar code scanner that is communicatively coupled to the bill validator (similar to the receiver). In such a configuration, the mobile payment can be provided by a scan of the bar code presented on the screen of the mobile device.

In some example embodiments, a bill validator can be combined with a ticket printer. For example, the wagering game machine can include a separate ticket printer associated with mobile payments. Alternatively an existing ticket printer can be used in conjunction with the bill validator to incorporate mobile payments therein. In such a configuration, a receiver can receive a mobile payment from the mobile device. The receiver can be communicatively coupled to the ticket printer. Also, the ticket printer can be coupled to output a ticket into the stacker of the bill validator. Upon receipt of the mobile payment, the receiver can forward the mobile payment to the ticket printer. The ticket printer can output a ticket (that represents the monetary value of the mobile payment) to the stacker of the bill validator. The ticket can then be processed like other tickets and bills received by the stacker. In particular, the stacker can forward the ticket to a validator for scanning to determine its value. That value is then credited for wagering game play at the wagering game machine.

In some example embodiments, the existing ticket printer of the wagering game machine can be used in a different configuration. In particular, a receiver can be communicatively coupled with the ticket printer. In operation, the mobile device can communicate a mobile payment to the receiver. The receiver can then forward the mobile payment to the ticket printer. In response, the ticket printer can output a printed ticket (that represents the monetary value of the mobile payment) out from the wagering game machine (like a ticket being output as part of cashing out by the wagering game player). The wagering game player can the input the ticket into the bill validator of the wagering game machine to receive game credits on the wagering game machine.

A similar configuration can be provided in a kiosk at a wagering game establishment. Specifically, the kiosk that typically outputs tickets based on money inserted thereto. In some example embodiments, the kiosk can be configured to include a receiver that is communicatively coupled with the ticket printer of the kiosk. In operation, the mobile device can communicate a mobile payment to the receiver. The receiver can then forward the mobile payment to the ticket printer. In response, the ticket printer can output a ticket (that represents the monetary value of the mobile payment) out from the kiosk (like a ticket being output in response to cash being inserted into the kiosk). The wagering game player can then input the ticket into the bill validator of any wagering game machine to receive game credits thereon.

While these different embodiments are described in separate systems. Such embodiments can be combined in different combinations. For example, the transfer in of mobile payments using a bill validator and transfer out of mobile credits using a ticket printer can be incorporated into a same wagering game machine.

System Environments

This section describes various system environments of some example embodiments. This section includes various configurations for mobile payment integration. This various configurations can operate separately or together. For example, the mobile payment integration for accepting mobile payments through a bill validator can be combined with issuing mobile credits through a ticket printer in a same wagering game machine.

The section will discuss FIGS. 1-6. The discussion of FIGS. 1-3 will describe various embodiments for accepting mobile payment through a bill validator in a wagering game machine to enable wagering game play based on the mobile payment. The discussion of FIG. 4 will describe an embodiment for issuing mobile credit to a mobile device in response to cashing out wagering game credit from a wagering game machine. The discussion of FIG. 5 will describe an embodiment for accepting mobile payment through a ticket printer of a wagering game machine, wherein the ticket printer issues a ticket based on the mobile payment. A wagering game player can then input the ticket into the bill validator of the wagering game machine to receive wagering game credit for game play. The discussion of FIG. 6 will describe an embodiment for accepting mobile payment through a ticket printer of a kiosk within a wagering game establishment, wherein the ticket printer issues a ticket based on the mobile payment. A wagering game player can the input the ticket into a bill validator of any wagering game machine to receive wagering game credit for game play.

FIG. 1 depicts a wagering game system with a wagering game machine having mobile payment integration for receiving mobile payments for wagering game play, according to some example embodiments. In particular, FIG. 1 depicts a system 100 that includes a wagering game machine 102, a backend server 104, a validation server 106 and a mobile device 108.

The system 100 also includes a network 110 and a network 112. The mobile device 108 is communicatively coupled (wired or wireless) to the wagering game machine 102 and the network 112. The validation server 106 is communicatively coupled to the network 110 and the network 112. The backend server 104 and the wagering game machine 102 are communicatively coupled to the network 110.

The validation server 106 includes a validation module 128, which can be software, firmware, hardware or a combination thereof. In this example configuration, the validation server 106 can be a server that is external to the wagering game establishment that includes the wagering game machine 102. The validation module 128 is to validate mobile payments and mobile credits for a mobile device. The validation server 106 can be controlled by the service provider of the mobile service, a financial institution that is controlling the electronic funds associated with the mobile payments and mobile credits, etc.

In this example configuration, the backend server 104 can be a server that is controlled by the wagering game establishment that includes the wagering game machine 102. The backend server 104 includes a payment tracking module 124, a tickets database 125, a mobile payments database 126, and a bills database 127. The payment tracking module 124 can be software, firmware, hardware or a combination thereof. The payment tracking module 124 is configured to receive communications regarding the different types of payments paid into the wagering game machine 102 by wagering game players to receive wagering game credit for game play. In this example configuration, the payment tracking module 124 tracks three types of payments. A first payment is in the form of monetary bills (e.g., 20 dollar bills, 100 dollar bills, etc.) inserted into a bill validator of the wagering game machine 102. A second payment is in the form of tickets also inserted into a bill validator of the wagering game machine 102. The tickets can include a bar code that represents a monetary amount. The wagering game players typically receive the tickets from a ticket printer from a wagering game machine when a player cashes out, from a ticket printer from a kiosk in the wagering game establishment, etc. A third payment is in the form of mobile payments that are received from a mobile device. Accordingly, the payment tracking module 124 stores tracking data for the tickets in the tickets database 125; stores tracking data for the mobile payments in the mobile payments database 126; and stores tracking data for the monetary bills in the bills database 127. Such a configuration is in contrast to a conventional configuration that only tracks tickets and monetary bills.

In some example embodiments, a protocol (e.g., Slot Accounting System (SAS), Game To System (G2S), etc.) used in a conventional configuration (not having mobile payments) is used for communications between the wagering game machine 102 and the backend server 104. The existing protocol can be modified to add an additional field for mobile payments. Alternatively, the protocol can be modified to allow an existing field to have an additional value. For example in a conventional configuration, the protocol can include an existing field (that can have two values) to define whether the payment is a ticket or a monetary bill. In some example embodiments, this existing field can have a third value for mobile payments. Accordingly, a new protocol is not required for communication between the wagering game device 102 and the backend server 104.

The wagering game machine 102 includes a central processing unit 122 that is executing a wagering game module 123. The wagering game machine 102 includes a bill validator 114, a mobile payment receiver 120 and a credit meter 121. The bill validator 114 includes a bill acceptor 115, a stacker 116, a validator 118 and a bill validation module 119. The bill validation module 119 can be software, firmware, hardware or a combination thereof for controlling the operations in the bill validator 114.

In a conventional operation, a wagering game player 190 inserts a bill 129 (which can also represent a ticket) into the bill acceptor 115. The bill acceptor 115 passes the bill 129 into the stacker 116 (shown as having a number of bills 117 stacked). The stacker 116 passes the bills to the validator 118. The validator 118 then scans the bill to determine its monetary value. The validator 118 can provide this monetary value along with other relevant information about the bill to the bill validation module 119. For example, the validator 118 can also provide the time and date when the bill was inserted into the wagering game machine 102, whether it was a bill or ticket, etc. The bill validation module 119 can then transmit a communication to the wagering game module 123 executing on the central processing unit 122. The communication can provide this monetary value and other relevant information about the bill. In response, the wagering game module 123 can transmit a communication to the credit meter 121 to add additional wagering game credits that equal the monetary value of the bill. Also, the wagering game module 123 can transmit a communication over the network 110 to the payment tracking module. The communication can provide this monetary value and other relevant information about the bill. The payment tracking module 124 can then update the appropriate database based on this data in the communication.

In a different operation, a mobile payment is added to the wagering game device 102 from the mobile device 108 using this same bill validator 114. As described, the existing infrastructure of a wagering game device and network configuration can be used for adding mobile payment technology with limited changes to thereto. In particular, the mobile payment receiver 120 has been added to the wagering game machine 102. Also, the mobile payment receiver 120 is communicatively coupled to the bill validation module 119. There are also some minor modifications to the operations of the wagering game device 102 and the back-end server 104 to enable mobile payment technology.

In operation, the mobile device 108 communicates with the mobile payment receiver 120. The signals from the mobile device regarding the mobile payments can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile payments can be based on a number of different payment models.

For example, one payment model can be direct mobile billing wherein a player has a mobile account with a monetary amount therein. Accordingly, the player's mobile account is debited the amount of the mobile payment. The player authorizes the mobile payment based on one more authentications. For example, the player can input the monetary amount to be debited, a pin and a password (e.g., one time password). This information is communicated from the mobile device back to the validation server 106 (shown as validation 130). As shown in FIG. 1, the validation 130 can be communicated from the mobile device 108 to the validation server 106 over the network 112. Alternatively or in addition, the validation 130 can be communicated from the mobile device 108 to the mobile payment receiver 120. The validation 130 is then forwarded to the bill validation module 119. The bill validation module 119 forwards the validation 130 to the wagering game module 123. The wagering game module 123 forwards the validation 130 out from the wagering game machine 102 over the network 110 to the validation server 106. The validation module 128 can then validate the mobile payment. This can include debiting the mobile account at the validation server 106 and transmitting a confirmation back to the mobile device 108 to indicate that the mobile payment is allowed. Similar to the validation 130, this confirmation can be sent over the network 112 to the mobile device 108 or over the network 110 to the wagering game machine 102 and back to the mobile device 108. If this confirmation is sent through the wagering game machine 102, the mobile payment receiver 120 would be both a receiver and transmitter communicating with the mobile device 108.

In another payment model, mobile web payment can be used. In this example, the mobile device 108 can display a web page (using for example Wireless Application Protocol (WAP)). The player can then make a mobile payment using the web page. Again, this can include one or more authentications by the player (e.g., pin, password, etc.). The mobile device 108 can communicate the mobile web payment to the validation server 106 (shown as validation 130). Similar to the direct mobile billing, the validation 130 for mobile web payment can be communicated over the network 112 and/or through the wagering game device 102 and over the network 110. Also similar to the direct mobile billing, the validation module 128 can provide confirmation back to the mobile device 108.

In another payment model, SMS or USSD text messaging can be used. In this example, the player can communicate a text to the validation server 106 (shown as validation 130). The text can include the monetary amount. This monetary amount can then be charged to the player's phone bill or their electronic wallet. Again, this can include one or more authentications by the player (e.g., pin, password, etc.). The mobile device 108 can communicate the mobile web payment to the validation server 106 (shown as validation 130). Similar to the direct mobile billing, the validation 130 for text messaging can be communicated over the network 112 and/or through the wagering game device 102 and over the network 110. Also similar to the direct mobile billing, the validation module 128 can provide confirmation back to the mobile device 108.

Once the validation is complete, the mobile device 108 transmits the mobile payment 131 to the mobile payment receiver 120. The mobile payment receiver 120 forwards the mobile payment 131 to the bill validation module 119.

A conventional bill validation module in a bill validator has been modified to process the mobile payment. For example, assume that the bill validation module 119 is software, the software can be updated (e.g., through a download or swap out of the bill validator 114 with the new software). In response, the bill validation module 119 creates a communication 133 that is transmitted to the wagering game module 123. The communication 133 indicates that a payment based on a mobile payment has been received by the bill validator 114. The communication 133 can include the monetary value, the time and date, an indication that the payment was a mobile payment, etc.

In some example embodiments, a protocol (e.g., Gaming Device Standard (GDS)) used in a conventional configuration (not having mobile payments) is used for communications between the bill validator 114 and the central processing unit 122. The existing protocol can be modified to add an additional field for mobile payments. Alternatively, the protocol can be modified to allow an existing field to have an additional value. For example in a conventional configuration, the protocol can include an existing field (that can have two values) to define whether the payment is a ticket or a monetary bill. In some example embodiments, this existing field can have a third value for mobile payments. Accordingly, a new protocol is not required for communication between the bill validator 114 and the central processing unit 122.

In response, the wagering game module 123 creates a communication 134 that is transmitted to the credit meter 121. The communication 134 includes an instruction to issue a wagering game credit based on the mobile payment that is equal in monetary value to the mobile payment. Also in response to receiving the communication 133, the wagering game module 123 forwards the communication 133 over the network 110 to the backend server 104 to enable the payment tracking. In particular, upon receipt, the payment tracking module 124 updates the mobile payments database 126 with the mobile payment 130 received from the mobile device 108. As described above, the communications between the wagering game machine 102 and the backend server can be based on an existing protocol (e.g., SAS, G2S, etc.) for the mobile payment tracking. Accordingly, a new protocol is not required for communication between the wagering game device 102 and the backend server 104.

Figure 2:
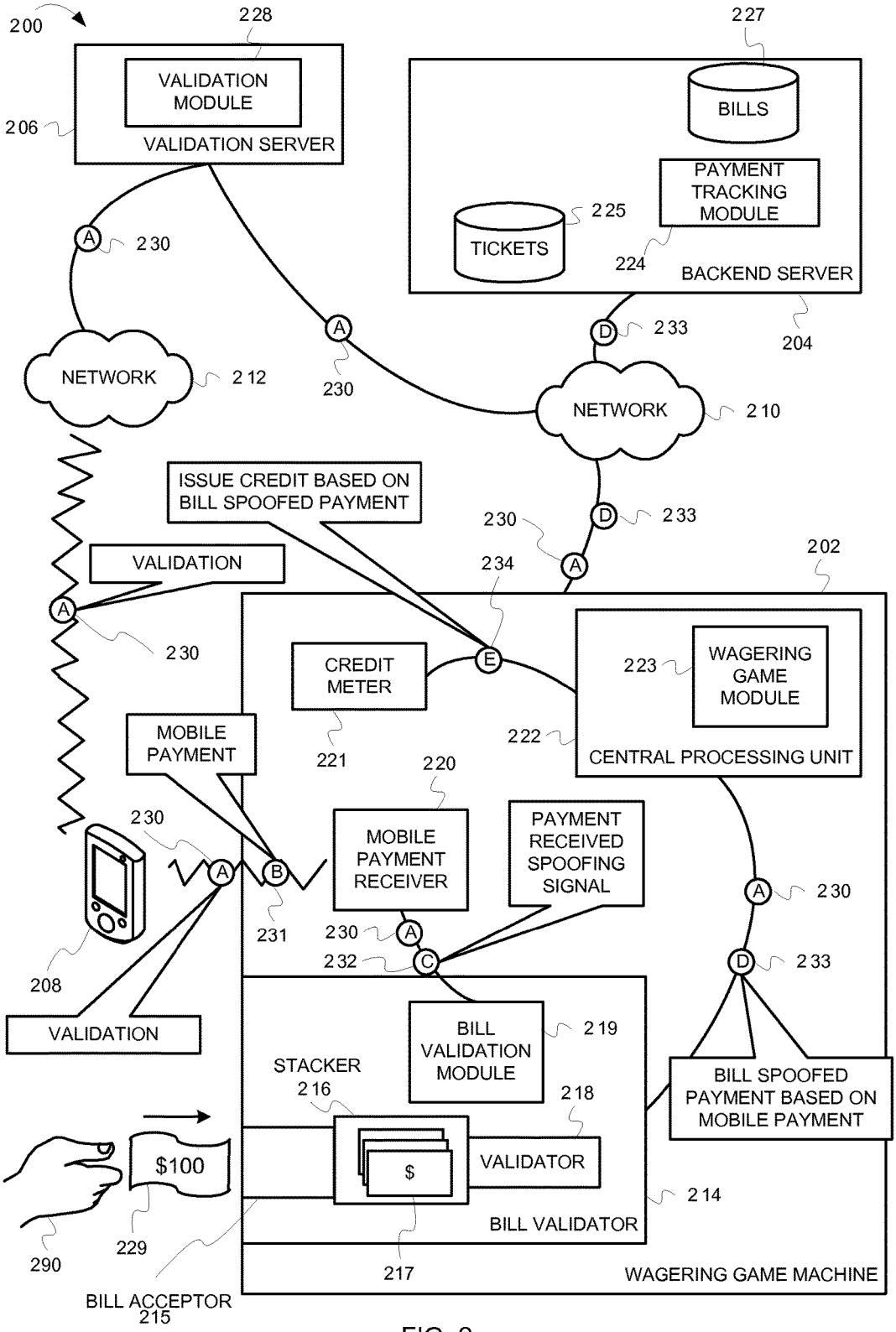
FIG. 2 depicts a wagering game system with a wagering game machine having mobile payment integration for receiving mobile payments for wagering game play, according to some other example embodiments.

FIG. 2 depicts a wagering game system with a wagering game machine having mobile payment integration for receiving mobile payments for wagering game play, according to some other example embodiments. In particular, FIG. 2 depicts a system 200 that includes a wagering game machine 202, a backend server 204, a validation server 206 and a mobile device 208. In contrast to the system 100 of FIG. 1, the system 200 of FIG. 2 spoofs the acceptance of a bill or ticket by the bill validator, in response to receiving the mobile payment. Accordingly, in this configuration, a mobile payment category is not separately identified and tracked. Such a configuration can further minimize the amount of changes to an existing wagering game machine and system, in comparison to the configuration shown in FIG. 1. In particular in some example embodiments, additional software and protocol changes are not required for tracking the mobile payments.

The system 200 also includes a network 210 and a network 212. The mobile device 208 is communicatively coupled (wired or wireless) to the wagering game machine 202 and the network 212. The validation server 206 is communicatively coupled to the network 210 and the network 212. The backend server 204 and the wagering game machine 202 are communicatively coupled to the network 210.

The validation server 206 includes a validation module 228, which can be software, firmware, hardware or a combination thereof. The validation server 206 and the validation module 228 executing therein can be configured and operate similar to the validation server 106 and the validation module 128 of FIG. 1.

In this example configuration, the backend server 204 can be a server that is controlled by the wagering game establishment that includes the wagering game machine 202. The backend server 204 includes a payment tracking module 224, a tickets database 225 and a bills database 227.

The payment tracking module 224 can be software, firmware, hardware or a combination thereof. The payment tracking module 224 is configured to receive communications regarding the different types of payments paid into the wagering game machine 202 by wagering game players to receive wagering game credit for game play. In this example configuration, the payment tracking module 124 tracks two (instead of three) types of payments. A first payment is in the form of monetary bills inserted into a bill validator of the wagering game machine 202. A second payment is in the form of tickets also inserted into a bill validator of the wagering game machine 202. Accordingly, the payment tracking module 224 stores tracking data for the tickets in the tickets database 225 and stores tracking data for the monetary bills in the bills database 227.

In some example embodiments, a protocol (e.g., Slot Accounting System (SAS), Game To System (G2S), etc.) used in a conventional configuration (not having mobile payments) is used for communications between the wagering game machine 202 and the backend server 204. In this example configuration and in contrast to the system 100 of FIG. 1, the existing protocol is not required to be modified to account for mobile payments. In particular as further described below, the mobile payment is spoofed such that the bill validator assumes that the mobile payment is a bill or a ticket. Accordingly, a new protocol is not required for communication between the wagering game device 202 and the backend server 204.

The wagering game machine 202 includes a central processing unit 222 that is executing a wagering game module 223. The wagering game machine 202 includes a bill validator 214, a mobile payment receiver 220 and a credit meter 221. The bill validator 214 includes a bill acceptor 215, a stacker 216 (storing a number of bills 217), a validator 218 and a bill validation module 219. The bill validation module 219 can be software, firmware, hardware or a combination thereof for controlling the operations in the bill validator 214.

Like the system 100 of FIG. 1, the bill validator 214 can perform the conventional operation of accepting and processing bills and tickets received into the bill acceptor 215 (see description above of the conventional operation of the bill validator 114 in FIG. 1). After determining a monetary value of a ticket or bill, the bill validation module 219 can then transmit a communication to the wagering game module 223 executing on the central processing unit 222. The communication can provide this monetary value and other relevant information about the bill. In response, the wagering game module 223 can transmit a communication to the credit meter 221 to add additional wagering game credits that equal the monetary value of the bill. Also, the wagering game module 223 can transmit a communication over the network 210 to the payment tracking module 224. The communication can provide this monetary value and other relevant information about the bill. The payment tracking module 224 can then update the appropriate database based on this data in the communication.

In a different operation, a mobile payment is spoofed such that the mobile payment is processed as a bill or ticket. In particular, a mobile payment is added to the wagering game device 202 from the mobile device 208 using this same bill validator 214. As described, the existing infrastructure of a wagering game device and network configuration can be used for adding mobile payment technology with limited changes to thereto. In particular, the mobile payment receiver 220 has been added to the wagering game machine 202. Also, the mobile payment receiver 220 is communicatively coupled to the bill validation module 219.

In operation, the mobile device 208 communicates with the mobile payment receiver 220. The signals from the mobile device regarding the mobile payments can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile payments can be based on a number of different payment models (see description of the example payment models above in reference to FIG. 1). The validation is performed for the mobile payment (see description above in reference to FIG. 1).

Once the validation is complete, the mobile device 208 transmits the mobile payment 231 to the mobile payment receiver 220. Upon receipt, the mobile payment receiver 220 transmits a communication 232 (that is a spoofing signal) to the bill validation module 219. The communication 232 is configured such that the bill validation module 219 assumes that it is receiving and processing a ticket or bill. For example, the communication sent from the validator 218 to the bill validation module 219 to indicate that a bill or ticket of a given monetary value can be replicated by the mobile payment receiver 220. Accordingly, the communication from the mobile payment receiver 220 can be the same as the communication from the validator 218. The bill validation module 218 would then process the communication 232 from the mobile payment receiver 220 the same as a communication from the validator 218. The bill validation module 219 would then send a communication to the wagering game module 223 (shown as a communication 233). The communication 233 can include the monetary value, the time and date, an indication that the payment was a bill or ticket, etc.

In some example embodiments, a protocol (e.g., Gaming Device Standard (GDS)) used in a conventional configuration (not having mobile payments) is used for communications between the bill validator 214 and the central processing unit 222. In this configuration, the existing protocol would not be required to be modified to account for mobile payments. Accordingly, a new protocol is not required for communication between the bill validator 214 and the central processing unit 222.

In response, the wagering game module 223 creates a communication 234 that is transmitted to the credit meter 221. The communication 234 includes an instruction to issue a wagering game credit based on the spoof signal that is equal in monetary value to the mobile payment. Also in response to receiving the communication 233, the wagering game module 223 forwards the communication 233 over the network 210 to the backend server 204 to enable the payment tracking. In particular, upon receipt, the payment tracking module 224 updates either the tickets database 225 or the bills database 227 (depending on whether the mobile payment was spoofed as a ticket or a bill). As described above, the communications between the wagering game machine 202 and the backend server 204 can be based on an existing protocol (e.g., SAS, G2S, etc.). Accordingly, a new protocol is not required for communication between the wagering game device 202 and the backend server 204.

Figure 3:
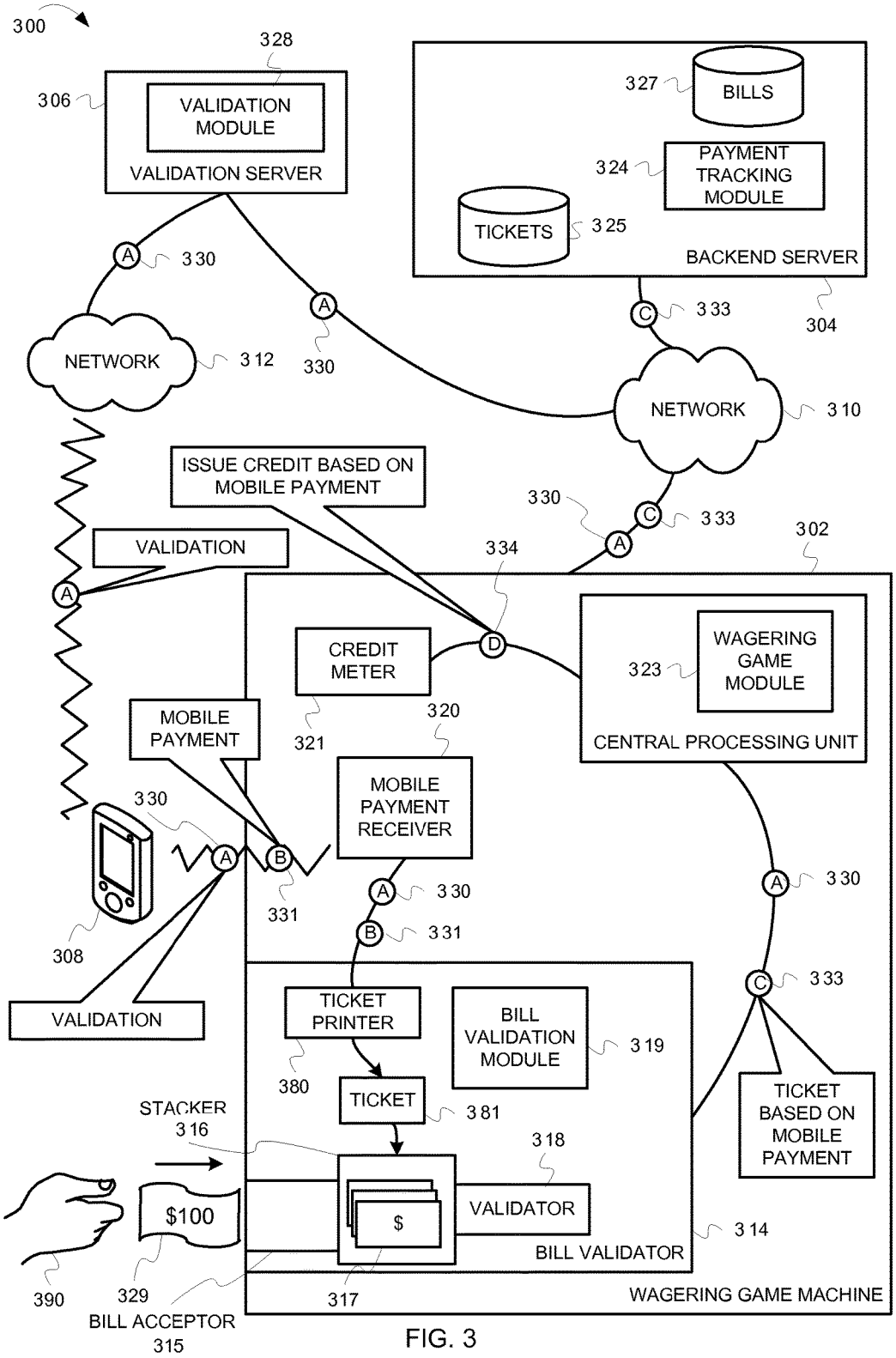
FIG. 3 depicts a wagering game system with a wagering game machine having mobile payment integration for receiving mobile payments for wagering game play, according to some other example embodiments.

FIG. 3 depicts a wagering game system with a wagering game machine having mobile payment integration for receiving mobile payments for wagering game play, according to some other example embodiments. In contrast to the systems in FIGS. 1 and 2, FIG. 3 incorporates a ticket printer with the bill validator of the wagering game machine. In such a configuration, mobile payments can be integrated into the wagering game machine such that a ticket is printed in response to a mobile payment. This ticket can then be inputted into the stacker of the bill validator to be processed as a ticket. A more detailed description of the operations of FIG. 3 is now described.

FIG. 3 depicts a system 300 that includes a wagering game machine 302, a backend server 304, a validation server 306 and a mobile device 308. The system 300 also includes a network 310 and a network 312. The mobile device 308 is communicatively coupled (wired or wireless) to the wagering game machine 302 and the network 312. The validation server 306 is communicatively coupled to the network 310 and the network 312. The backend server 304 and the wagering game machine 302 are communicatively coupled to the network 310.

The validation server 306 includes a validation module 328, which can be software, firmware, hardware or a combination thereof. The validation server 306 and the validation module 328 executing therein can be configured and operate similar to the validation server 106 and the validation module 128 of FIG. 1.

In this example configuration, the backend server 304 can be a server that is controlled by the wagering game establishment that includes the wagering game machine 302. The backend server 304 includes a payment tracking module 324, a tickets database 325 and a bills database 327.

The payment tracking module 324 can be software, firmware, hardware or a combination thereof. The payment tracking module 324 is configured to receive communications regarding the different types of payments paid into the wagering game machine 302 by wagering game players to receive wagering game credit for game play. In this example configuration, the payment tracking module 324 tracks two (instead of three) types of payments. A first payment is in the form of monetary bills inserted into a bill validator of the wagering game machine 302. A second payment is in the form of tickets also inserted into a bill validator of the wagering game machine 302. Accordingly, the payment tracking module 324 stores tracking data for the tickets in the tickets database 325 and stores tracking data for the monetary bills in the bills database 327.

In some example embodiments, a protocol (e.g., Slot Accounting System (SAS), Game To System (G2S), etc.) used in a conventional configuration (not having mobile payments) is used for communications between the wagering game machine 302 and the backend server 304. In this example configuration and in contrast to the system 100 of FIG. 1, the existing protocol is not required to be modified to account for mobile payments. In particular as further described below, the mobile payment is converted into a printed ticket and then processed as such. Thus, the backend server does not knowledge of the mobile payment in this example configuration. Accordingly, a new protocol is not required for communication between the wagering game device 202 and the backend server 204.

The wagering game machine 302 includes a central processing unit 322 that is executing a wagering game module 323. The wagering game machine 302 includes a bill validator 314, a mobile payment receiver 320 and a credit meter 321. The bill validator 314 includes a bill acceptor 315, a stacker 316 (storing a number of bills 317), a validator 318, a bill validation module 319 and a ticket printer 380. The bill validation module 319 can be software, firmware, hardware or a combination thereof for controlling the operations in the bill validator 314.

Like the system 100 of FIG. 1, the bill validator 314 can perform the conventional operation of accepting and processing bills and tickets received into the bill acceptor 315 (see description above of the conventional operation of the bill validator 114 in FIG. 1). After determining a monetary value of a ticket or bill, the bill validation module 319 can then transmit a communication to the wagering game module 323 executing on the central processing unit 322. The communication can provide this monetary value and other relevant information about the bill. In response, the wagering game module 323 can transmit a communication to the credit meter 321 to add additional wagering game credits that equal the monetary value of the bill. Also, the wagering game module 323 can transmit a communication over the network 310 to the payment tracking module 324. The communication can provide this monetary value and other relevant information about the bill/ticket. The payment tracking module 324 can then update the appropriate database based on this data in the communication.

In a different operation, a mobile payment is converted into a printed ticket and then processed as a printed ticket. In particular, a mobile payment is added to the wagering game device 302 from the mobile device 308 using this same bill validator 314. As described, the existing infrastructure of a wagering game device and network configuration can be used for adding mobile payment technology with limited changes to thereto. In particular, the mobile payment receiver 320 has been added to the wagering game machine 302. Also, the mobile payment receiver 320 is communicatively coupled to the ticket printer 380.

In operation, the mobile device 308 communicates with the mobile payment receiver 320. The signals from the mobile device regarding the mobile payments can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile payments can be based on a number of different payment models (see description of the example payment models above in reference to FIG. 1). The validation is performed for the mobile payment (see description above in reference to FIG. 1).

Once the validation is complete, the mobile device 308 transmits the mobile payment 331 to the mobile payment receiver 320. The mobile payment receiver 320 forwards the mobile payment 331 to the ticket printer 380. In response, the ticket printer 380 prints a ticket 381. The ticket 381 can include a bar code that represents a monetary amount equaling the value of the mobile payment 331. Also, the ticket printer 380 is coupled to the stacker 316 such that the tickets printed from the ticket printer 380 are placed into the stacker 316. Thus, the ticket 381 is placed into the stacker 316. The ticket 381 can then be forwarded to the validator 318. After determining a monetary value of the ticket 381 based on a scanning of the ticket 318, the validator 318 forwards the monetary value to the bill validation module 319. The bill validation module 319 can then transmit a communication to the wagering game module 323 executing on the central processing unit 322. The communication can provide this monetary value and other relevant information about the ticket 381 (e.g., time and date when the ticket was inserted into the wagering game machine 102).

In some example embodiments, a protocol (e.g., Gaming Device Standard (GDS)) used in a conventional configuration (not having mobile payments) is used for communications between the bill validator 314 and the central processing unit 322. In this configuration, the existing protocol would not be required to be modified to account for mobile payments. Accordingly, a new protocol is not required for communication between the bill validator 314 and the central processing unit 322.

In response, the wagering game module 323 can transmit a communication to the credit meter 321 to add additional wagering game credits that equal the monetary value of the mobile payment. Also, the wagering game module 323 can transmit a communication over the network 310 to the payment tracking module 324. The communication can provide this monetary value and other relevant information about the ticket 381. The payment tracking module 324 can then update the tickets database 325 based on this data in the communication. As described above, the communications between the wagering game machine 302 and the backend server 304 can be based on an existing protocol (e.g., SAS, G2S, etc.). Accordingly, a new protocol is not required for communication between the wagering game device 302 and the backend server 304.

While described such that the ticket printer 380 is within the bill validator 314, in some other example embodiments, the ticket printer 380 can be external to the bill validator 314. Also, in some example embodiments, an existing ticket printer in the wagering game machine can be replaced or modified such that the ticket printer includes an additional output. This additional output can be coupled to the stacker 316 for placing the tickets for mobile payments therein. Accordingly, the ticket printer can be coupled to the mobile payment receiver. Upon receipt of a mobile payment, the ticket printer would output a printed ticket to this additional output.

Figure 4:
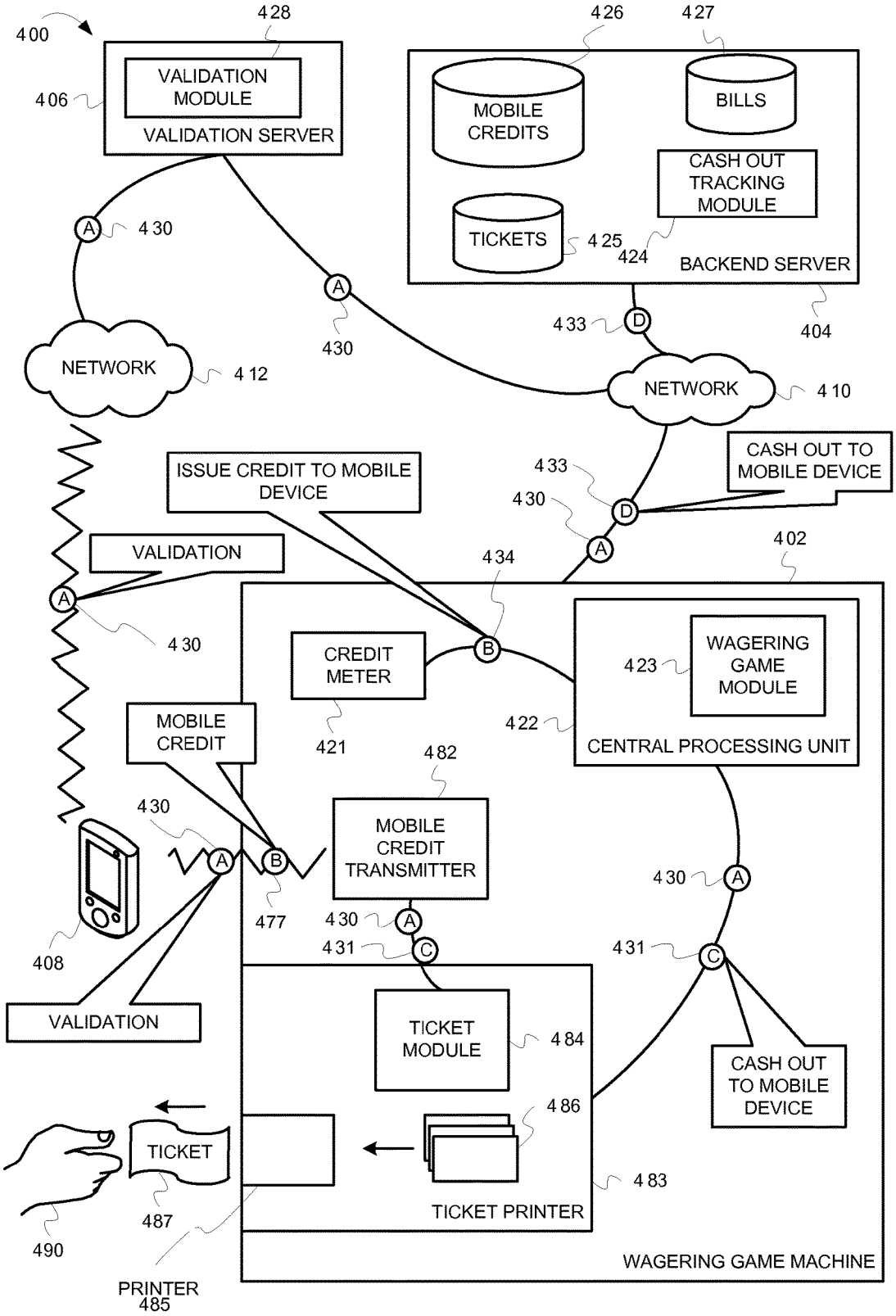
FIG. 4 depicts a wagering game system with a wagering game machine having mobile payment integration for cashing out to a mobile device, according to some example embodiments.

FIG. 4 depicts a wagering game system with a wagering game machine having mobile payment integration for cashing out to a mobile device, according to some example embodiments. In this example configuration, the mobile communication between a mobile device and a wagering game machine is used to cash out wagering game credit to the mobile device instead of a ticket, monies, etc. In particular, FIG. 4 depicts a system 400 that includes a wagering game machine 402, a backend server 404, a validation server 406 and a mobile device 408.

The system 400 also includes a network 410 and a network 412. The mobile device 408 is communicatively coupled (wired or wireless) to the wagering game machine 402 and the network 412. The validation server 406 is communicatively coupled to the network 410 and the network 412. The backend server 404 and the wagering game machine 402 are communicatively coupled to the network 410.

The validation server 406 includes a validation module 428, which can be software, firmware, hardware or a combination thereof. In this example configuration, the validation server 406 can be a server that is external to the wagering game establishment that includes the wagering game machine 402. The validation module 428 is to validate mobile credits for a mobile device. The validation server 406 can be controlled by the service provider of the mobile service, a financial institution that is controlling the electronic funds associated with the mobile payments and mobile credits, etc.

In this example configuration, the backend server 404 can be a server that is controlled by the wagering game establishment that includes the wagering game machine 402. The backend server 404 includes a cash out tracking module 424, a tickets database 425, a mobile credits database 426 and a bills database 427.

The cash out tracking module 424 can be software, firmware, hardware or a combination thereof. The cash out tracking module 424 is configured to receive communications regarding the different types of cash outs paid out from the wagering game machine 402. In this example configuration, the cash out tracking module 424 tracks three types of cash outs. A first cash out is in the form of monetary bills/coins. A second cash out is in the form of tickets output from the ticket printer of the wagering game machine 402. A third cash out is in the form of a mobile credits output from the wagering game machine 402 to the mobile device 408. Accordingly, the cash out tracking module 424 stores tracking data for the cash out through tickets in the tickets database 425; stores tracking data for the cash out through the monetary bills/coins in the bills database 227; and stores tracking data for the cash out through the mobile credits in the mobile credits database 226.

In some example embodiments, a protocol (e.g., Slot Accounting System (SAS), Game To System (G2S), etc.) used in a conventional configuration (not having mobile credits) is used for communications between the wagering game machine 402 and the backend server 404. The existing protocol can be modified to add an additional field for mobile credits. Alternatively, the protocol can be modified to allow an existing field to have an additional value. For example in a conventional configuration, the protocol can include an existing field (that can have two values) to define whether the credit is a ticket or a monetary bill/coin. In some example embodiments, this existing field can have a third value for mobile credits. Accordingly, a new protocol is not required for communication between the wagering game device 402 and the backend server 404.

The wagering game machine 402 includes a central processing unit 422 that is executing a wagering game module 423. The wagering game machine 402 includes a ticket printer 483, a mobile credit transmitter 482 and a credit meter 421. The ticket printer 483 includes a ticket module 484, a number of tickets 486, and a printer 485. The ticket module 484 can be software, firmware, hardware or a combination thereof for controlling the operations in the ticket printer 483.

In a conventional operation, the ticket printer 483 can cash out wagering game credits available on the wagering game machine 402, in response to a wagering game player input a request (e.g., a button selection) to perform the cash out. In particular, the wagering game player can select a button to perform the cash out that causes a printing of a ticket representing a monetary value of the cash out value. In response, the credit meter 421 can transmit the cash out request to the wagering game machine 423. The wagering game module 423 can forward the request to the ticket printer 483. In response, the ticket module 484 can cause the printer to receive one of the tickets 486 and to print a monetary value thereon (e.g., a bar code) and to output the ticket (shown as a ticket 487) from the wagering game machine 402 to a wagering game player 490.

In a different operation, instead of outputting a printed ticket, the ticket printer 483 causes the cash out to be transmitted to the mobile device 408 as a mobile credit. In particular, a wagering game player can elect to cash out their remaining wagering game credits to the mobile device. The wagering game player can make this election of cash out to a mobile device based using a button selection based on a display of choices on the display of the wagering game machine. For example, in response to a cash out selection, the wagering game module 423 can present a display of choices on the screen of the wagering game machine using phrasing like: "1) Cash out with a mobile device, select button #1; or 2) Cash out with a printed ticket, select button #2." In some example embodiments, this display of choices can be presented only if the mobile credit transmitter 482 notifies the wagering game module 423 that there is active communication that has been established between the mobile credit transmitter 482 and the mobile device 408.

In response to a mobile credit cash out, the credit meter 421 transmits a communication 434 to the wagering game module 423 to issue the credit to the mobile device. The wagering game module 423 transmits a communication 431 to cash out to the mobile device to the ticket printer 483. In response, the ticket module 484 forwards the communication 431 to the mobile credit transmitter 482. The communication can include the monetary value of the cash out. The mobile credit transmitter 482 transmits a mobile credit communication 477 to the mobile device 408.

In some example embodiments, the communication 434 and the communication 431 do not identify whether the cash out operation is in the form of a printed ticket or in the form of a mobile credit. The ticket module 484 in the ticket printer 483 can make this determination. This determination can be made based on input from the player (button selection, etc.). In some example embodiments, if the mobile credit transmitter 482 is in communication with the mobile device 408, the cash out is in the form of a mobile credit. Otherwise, the cash out is in the form of a printed ticket.

In operation, the mobile device 408 communicates with the mobile credit transmitter 482. The signals from the mobile device regarding the mobile credits can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile credits can be based on a number of different payment models (see description of the example payment models above in reference to FIG. 1). For example, the mobile credit can be applied to a mobile account associated with the owner of the mobile device 408 using direct mobile billing, an online wallet, etc. In the system 400, the mobile device 408 communicates with the validation module 428 in the validation server 406 to ensure that the mobile credit has been applied to the owner's account (shown as communication 430). Similar to the mobile payment in FIGS. 1-3, the mobile credit validation can be communicated from the mobile device 408 through the network 412 and to the validation server 406. Alternatively or in addition, the mobile credit validation can communicated from the mobile device 408 through the wagering game machine 402 over the network 410 and to the validation server 406.

In some example embodiments, a protocol (e.g., Gaming Device Standard (GDS)) used in a conventional configuration (not having mobile payments) is used for communications between the ticket printer 483 and the central processing unit 422. In this configuration, the existing protocol can be modified to add an indication that the cash out is to occur through a mobile credit. Accordingly, a new protocol is not required for communication between the ticket printer 483 and the central processing unit 422.

Figure 5:
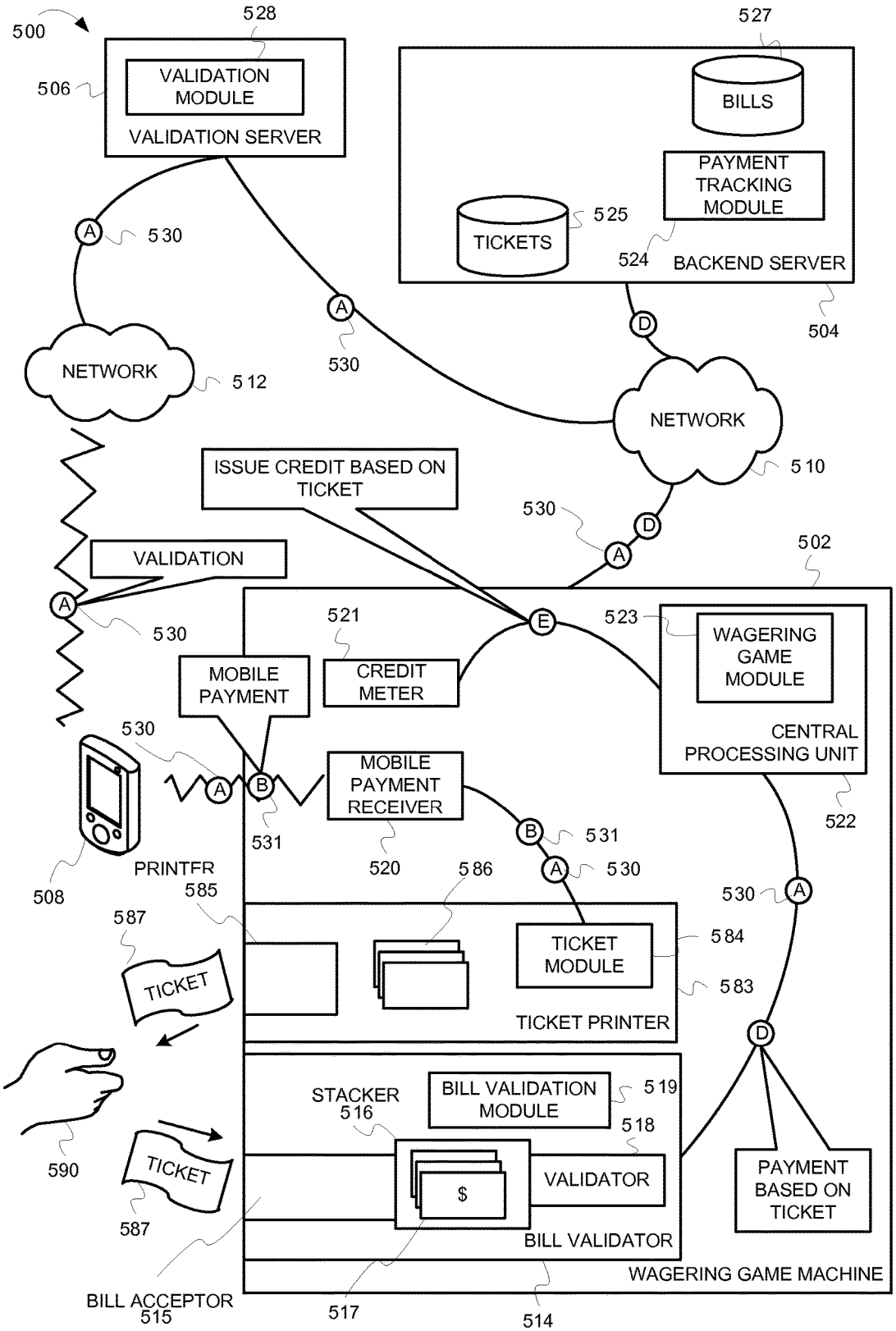
FIG. 5 depicts a wagering game system with a wagering game machine having mobile payment integration for outputting a ticket based on a mobile payment that is then used for wagering game play, according to some example embodiments.

FIG. 5 depicts a wagering game system with a wagering game machine having mobile payment integration for outputting a ticket based on a mobile payment that is then used for wagering game play, according to some example embodiments. In this example configuration, a mobile payment is received into a wagering game machine from a mobile device. In response, a ticket printer issues a printed ticket having a monetary value equal to the mobile payment. The wagering game player can then input the printed ticket into a bill validator of the wagering game machine.

FIG. 5 depicts a system 500 that includes a wagering game machine 502, a backend server 504, a validation server 506 and a mobile device 508. The system 500 also includes a network 510 and a network 512. The mobile device 508 is communicatively coupled (wired or wireless) to the wagering game machine 502 and the network 512. The validation server 506 is communicatively coupled to the network 510 and the network 512. The backend server 504 and the wagering game machine 502 are communicatively coupled to the network 510.

The validation server 506 includes a validation module 528, which can be software, firmware, hardware or a combination thereof. The validation server 506 and the validation module 528 executing therein can be configured and operate similar to the validation server 106 and the validation module 128 of FIG. 1.

In this example configuration, the backend server 504 can be a server that is controlled by the wagering game establishment that includes the wagering game machine 502. The backend server 504 includes a payment tracking module 524, a tickets database 525 and a bills database 527.

The payment tracking module 524 can be software, firmware, hardware or a combination thereof. The payment tracking module 524 is configured to receive communications regarding the different types of payments paid into the wagering game machine 502 by wagering game players to receive wagering game credit for game play. In this example configuration, the payment tracking module 524 tracks two (instead of three) types of payments. A first payment is in the form of monetary bills inserted into a bill validator of the wagering game machine 502. A second payment is in the form of tickets also inserted into a bill validator of the wagering game machine 502. Accordingly, the payment tracking module 224 stores tracking data for the tickets in the tickets database 525 and stores tracking data for the monetary bills in the bills database 527.

In some example embodiments, a protocol (e.g., Slot Accounting System (SAS), Game To System (G2S), etc.) used in a conventional configuration (not having mobile payments) is used for communications between the wagering game machine 502 and the backend server 504. In this example configuration and in contrast to the system 100 of FIG. 1, the existing protocol is not required to be modified to account for mobile payments. In particular as further described below, the mobile payment is converted into a printed ticket that is provided to the wagering game player. The wagering game player can then input the printed ticket back into the wagering game machine using the bill validator. Accordingly, a new protocol is not required for communication between the wagering game device 502 and the backend server 504 for mobile payments.

The wagering game machine 502 includes a central processing unit 522 that is executing a wagering game module 523. The wagering game machine 502 includes a bill validator 514, a ticket printer 583, a mobile payment receiver 520 and a credit meter 521. The ticket printer 583 includes a ticket module 584, a number of tickets 486, and a printer 585. The ticket module 584 can be software, firmware, hardware or a combination thereof for controlling the operations in the ticket printer 583. The bill validator 514 includes a bill acceptor 515, a stacker 516 (storing a number of bills/tickets 517), a validator 518 and a bill validation module 519. The bill validation module 519 can be software, firmware, hardware or a combination thereof for controlling the operations in the bill validator 514.

In a conventional operation, the ticket printer 583 can cash out wagering game credits available on the wagering game machine 502, in response to a wagering game player input a request (e.g., a button selection) to perform the cash out. In particular, the wagering game player can select a button to perform the cash out that causes a printing of a ticket representing a monetary value of the cash out value. In response, the credit meter 521 can transmit the cash out request to the wagering game machine 523. The wagering game module 523 can forward the request to the ticket printer 583. In response, the ticket module 584 can cause the printer to receive one of the tickets 586 and to print a monetary value thereon (e.g., a bar code) and to output the ticket (shown as a ticket 487) from the wagering game machine 502 to a wagering game player 590.

In a different operation, a mobile payment is converted into a printed ticket that is output from the wagering game machine to the wagering game player. In particular, a mobile payment is added to the wagering game device 502 from the mobile device 508 using the ticket printer 583. As described, the existing infrastructure of a wagering game device and network configuration can be used for adding mobile payment technology with limited changes to thereto. In particular, the mobile payment receiver 520 has been added to the wagering game machine 502. Also, the mobile payment receiver 520 is communicatively coupled to the ticket module 584.

In operation, the mobile device 508 communicates with the mobile payment receiver 520. The signals from the mobile device regarding the mobile payments can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile payments can be based on a number of different payment models (see description of the example payment models above in reference to FIG. 1). The validation is performed for the mobile payment (see description above in reference to FIG. 1).

Once the validation is complete, the mobile device 508 transmits the mobile payment 531 to the mobile payment receiver 520. Upon receipt, the mobile payment receiver 520 forwards the mobile payment 531 to the ticket module 584. A conventional ticket module in a ticket printer has been modified to process the mobile payment. For example, assume that the ticket module 584 is software, the software can be updated (e.g., through a download or swap out of the ticket module 584 with the new software). In response, the ticket module 584 causes the printer 585 to output a ticket 587 having a monetary value equal to the mobile payment received from the mobile device 508. A wagering game player 590 can receive the ticket 587 from the ticket printer 583 and input the ticket 587 into the bill validator 514.

The bill validator 514 can then process the ticket 587 as other printed tickets (see description above of the conventional operation of the bill validator 114 in FIG. 1). After determining a monetary value of the ticket 587, the bill validation module 519 can then transmit a communication to the wagering game module 523 executing on the central processing unit 522. The communication can provide this monetary value and other relevant information about the ticket 587. In response, the wagering game module 523 can transmit a communication to the credit meter 521 to add additional wagering game credits that equal the monetary value of the ticket 587. Also, the wagering game module 523 can transmit a communication over the network 510 to the payment tracking module 524. The communication can provide this monetary value and other relevant information about the ticket 587. The payment tracking module 524 can then update the tickets database 525 based on this data in the communication.

In some example embodiments, a protocol (e.g., Gaming Device Standard (GDS)) used in a conventional configuration (not having mobile payments) is used for communications between the bill validator 514 and the central processing unit 522. In this configuration, the existing protocol would not be required to be modified to account for mobile payments. Accordingly, a new protocol is not required for communication between the bill validator 514 and the central processing unit 522.

Figure 6:
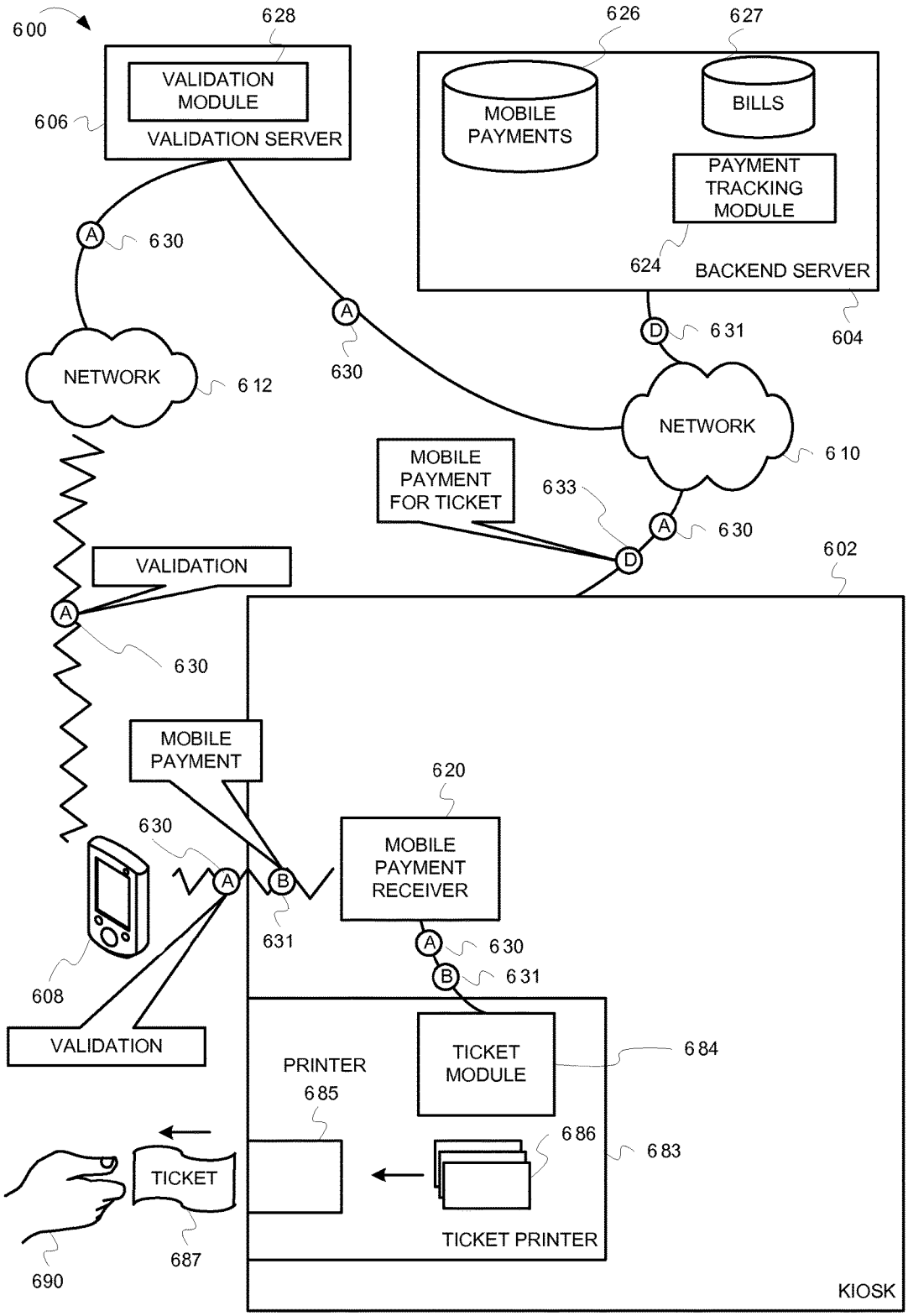
FIG. 6 depicts a ticket kiosk for a wagering game establishment and having mobile payment integration for outputting a ticket based on a mobile payment that is then used for wagering game play, according to some example embodiments.

Mobile payment integration into a kiosk that dispenses tickets for wagering game play at a wagering game establishment is now described. In particular, FIG. 6 depicts a ticket kiosk for a wagering game establishment and having mobile payment integration for outputting a ticket based on a mobile payment that is then used for wagering game play, according to some example embodiments. FIG. 6 depicts a system 600 that includes a kiosk 602, a backend server 604, a validation server 606 and a mobile device 608. The system 600 also includes a network 610 and a network 612. The mobile device 608 is communicatively coupled (wired or wireless) to the kiosk 602 and the network 612. The validation server 606 is communicatively coupled to the network 610 and the network 612. The backend server 604 and the kiosk 602 are communicatively coupled to the network 610.

The validation server 606 includes a validation module 628, which can be software, firmware, hardware or a combination thereof. The validation server 606 and the validation module 628 executing therein can be configured and operate similar to the validation server 606 and the validation module 628 of FIG. 6.

In this example configuration, the backend server 604 can be a server that is controlled by the wagering game establishment that includes the kiosk 602. The backend server 604 includes a payment tracking module 624, a mobile payments database 626 and a bills database 627.

The payment tracking module 624 can be software, firmware, hardware or a combination thereof. The payment tracking module 624 is configured to receive communications regarding the different types of payments paid into the kiosk 602 to receive tickets used for wagering game play at different wagering game machines in the wagering game establishment. In this example configuration, the payment tracking module 624 tracks two types of payments. A first payment is in the form of monetary bills inserted into a bill validator (not shown) of the kiosk 602. A second payment is in the form of mobile payments that are received from a mobile device. Accordingly, the payment tracking module 624 stores tracking data for the mobile payments in the mobile payments database 626 and stores tracking data for the monetary bills in the bills database 627.

In some example embodiments, a protocol (e.g., Slot Accounting System (SAS), Game To System (G2S), etc.) used in a conventional configuration (not having mobile payments) is used for communications between the kiosk 602 and the backend server 604. The existing protocol can be modified to add an additional field for mobile payments. Accordingly, a new protocol is not required for communication between the wagering game device 602 and the backend server 604.

The kiosk 602 includes a ticket printer 683 and a mobile payment receiver 620. The ticket printer 683 includes a ticket module 684, a number of tickets 686, and a printer 685. The ticket module 684 can be software, firmware, hardware or a combination thereof for controlling the operations in the ticket printer 683.

Like the system 100 of FIG. 1, the kiosk 602 can include a bill validator that can perform the conventional operation of accepting and processing bills. In response, the ticket module 684 can cause the printer 685 to receive one of the tickets 686 and to print a monetary value thereon (e.g., a bar code) and to output the ticket (shown as a ticket 687) from the kiosk 602 to a wagering game player 690. The ticket module 684 can also transmit a communication over the network 610 to the payment tracking module 624. The communication can indicate that a ticket was having a given monetary value at a certain date and time. The payment tracking module 624 can update the bills database 627 based on this communication.

In a different operation, a mobile payment is added to the kiosk 602 from the mobile device 608 using the ticket printer 683. As described, the existing infrastructure of a wagering game device and network configuration can be used for adding mobile payment technology with limited changes to thereto. In particular, the mobile payment receiver 620 has been added to the kiosk 602. Also, the mobile payment receiver 620 is communicatively coupled to the ticket module 684. There are also some minor modifications to the operations of the kiosk 602 and the backend server 604 to enable mobile payment technology.

In operation, the mobile device 608 communicates with the mobile payment receiver 620. The signals from the mobile device regarding the mobile payments can be either wired or wireless communications. Also, various protocols and communications standards can be used for this communication (e.g., Bluetooth, wireless Local Area Network (LAN), Near Field Communication (NFC), Short Message Service (SMS) messages, Unstructured Supplementary Service Data (USSD), Universal Serial Bus (USB), etc.). The mobile payments can be based on a number of different payment models (see description of the example payment models above in reference to FIG. 1). The validation 630 is performed for the mobile payment (see description above in reference to FIG. 1).

Once the validation is complete, the mobile device 608 transmits the mobile payment 631 to the mobile payment receiver 620. The mobile payment receiver 620 forwards the mobile payment 631 to the ticket module 684. A conventional ticket module in a ticket printer has been modified to process the mobile payment. For example, assume that the ticket module 684 is software, the software can be updated (e.g., through a download or swap out of the ticket printer 683 with the new software). In response, the ticket module 684 creates a communication 133 that is transmitted over the network 610 to the payment tracking module 624. The communication 133 indicates that a payment based on a mobile payment has been received by the ticket printer 683. The communication 633 can include the monetary value, the time and date, an indication that the payment was a mobile payment, etc. Upon receipt, the payment tracking module 624 updates the mobile payments bills database 626. As described above, the communications between the kiosk 602 and the backend server 604 can be based on an existing protocol (e.g., SAS, G2S, etc.). Accordingly, a new protocol is not required for communication between the wagering game device 602 and the backend server 604.

Example Operations

This section describes operations associated with some example embodiments. In the discussion below, the flowcharts will be described with reference to the block diagrams presented above. However, in some example embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some example embodiments, the operations can be performed in series, while in other embodiments, one or more of the operations can be performed in parallel. Moreover, some example embodiments can perform less than all the operations shown in any flowchart.

Figure 7:
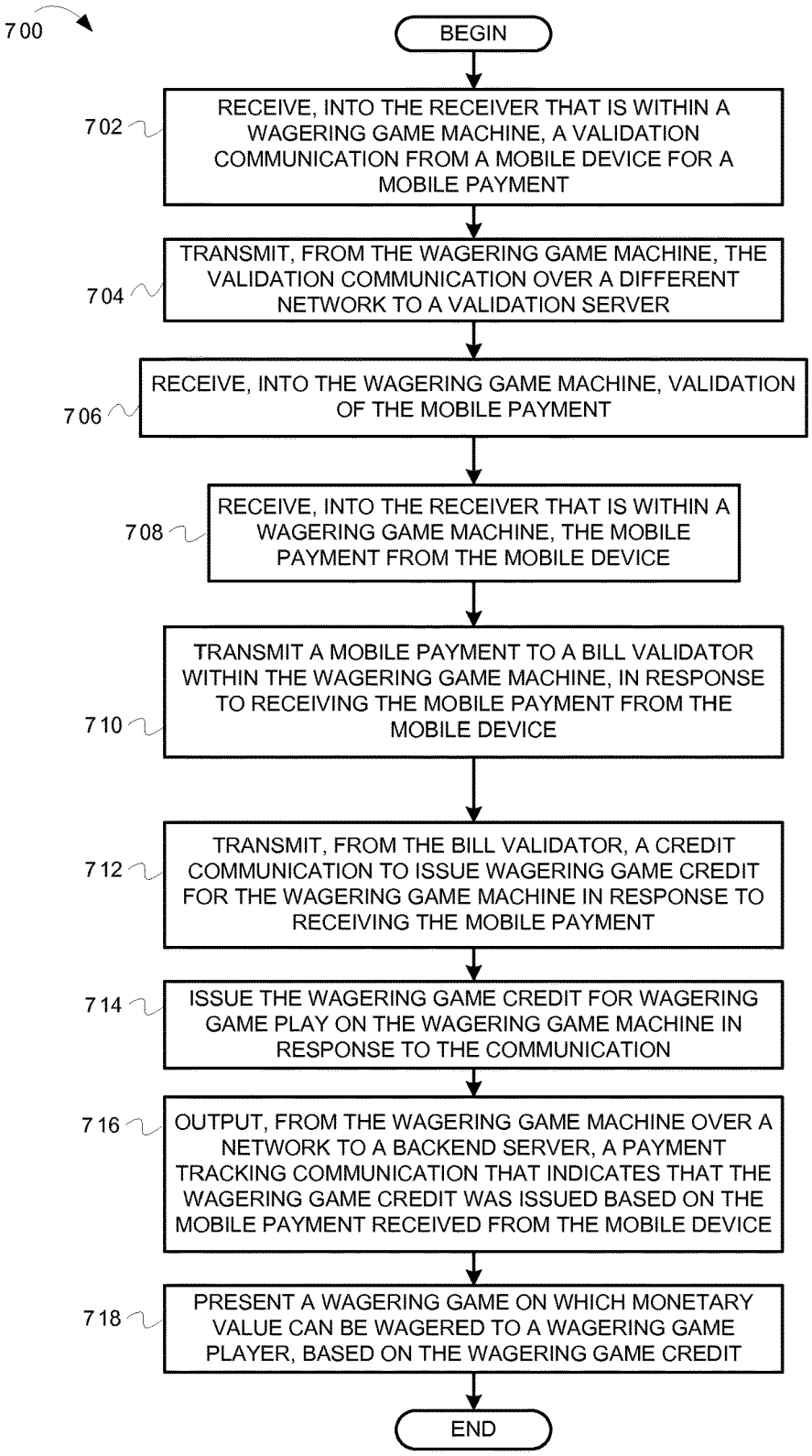
FIG. 7 depicts a flowchart for mobile payment integration into a wagering game system with a wagering game machine, according to some example embodiments.
Figure 8:
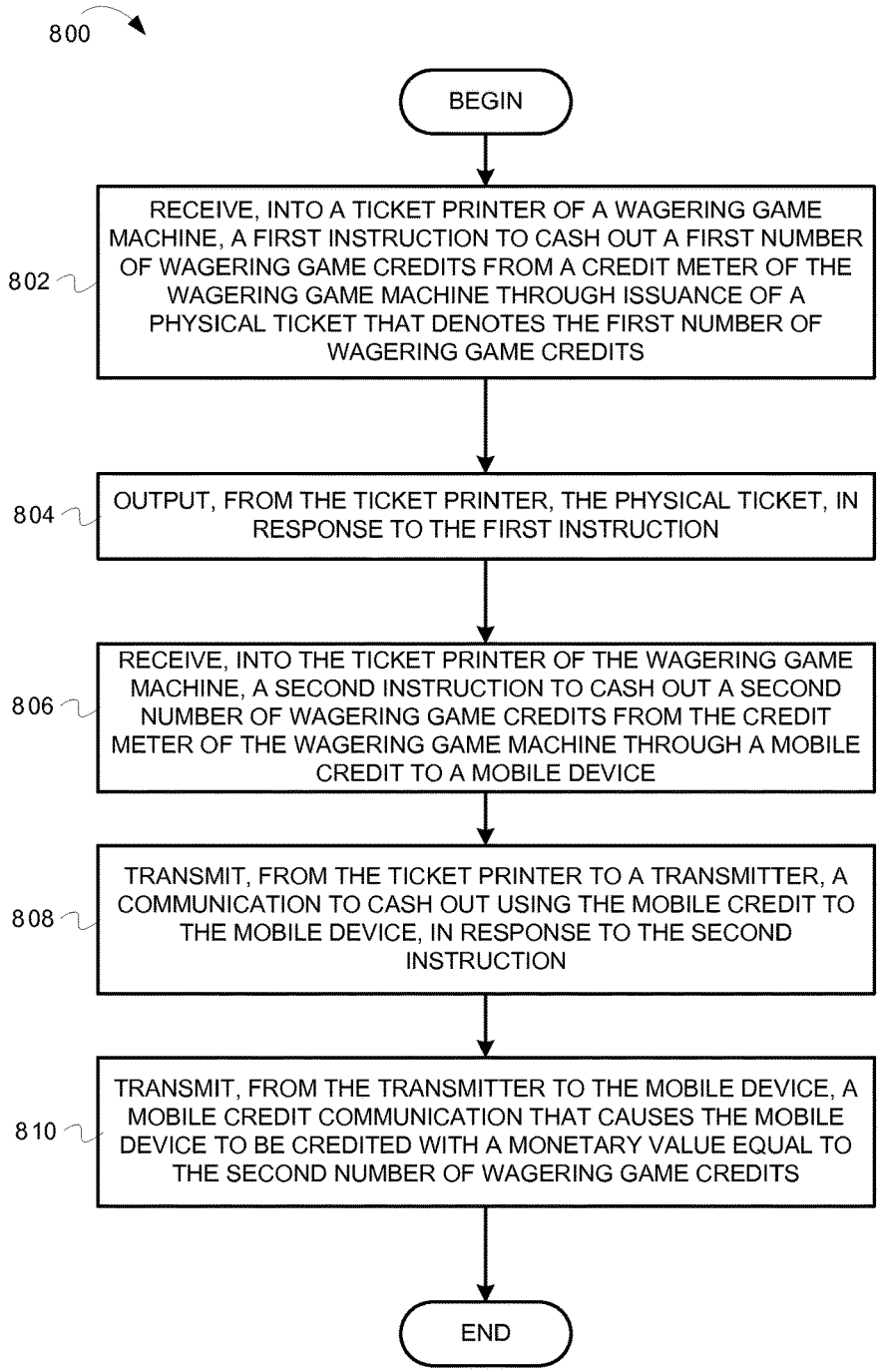
FIG. 8 depicts a flowchart for mobile credit integration into a wagering game system with a wagering game machine, according to some example embodiments.

The section will discuss FIGS. 7-8. The discussion of FIG. 7 will describe operations for mobile payment integration into a wagering game system. The discussion of FIG. 8 will describe operations for mobile credit integration into a wagering game system.

In particular, FIG. 7 depicts a flowchart for mobile payment integration into a wagering game system with a wagering game machine, according to some example embodiments. In this example, operations of a flowchart 700 are performed by different components of the wagering game machine 102 of FIG. 1. In the flowchart 700, the wagering game machine is involved with the communication regarding the validation of the mobile payment. However, as described above, in some example embodiments, the validation can be performed independent of the wagering game machine. In particular in some example embodiments, the operations of the flowchart 700 begin at block 706. In this configuration, the validation can be performed between the mobile device and the validation server (wherein the wagering game machine is not involved in the communication). The operations of the flowchart 700 begin at block 702.

At block 702, the mobile payment receiver 120 in the wagering game machine 102 receives a validation communication from a mobile device for a mobile payment. With reference to FIG. 1, the mobile payment receiver 120 receives the validation 130 from the mobile device 108. In this example configuration, the validation is transmitted back to the validation server 106 using the wagering game machine 102. The operations of the flowchart 700 continue at block 704.

At block 704, the wagering game module 123 transmits, from the wagering game machine, the validation communication over a network to a validation server. With reference to FIG. 1, in response to receiving the validation 130, the mobile payment receiver 120 forwards the validation 130 to the bill validation module 119, which forwards to the wagering game module 123. The wagering game module 123 then transmits the validation 130 over the network 110 to the validation server 106. The operations of the flowchart 700 continue at block 706.

At block 706, the mobile payment receiver 120 receives, into the wagering game machine, validation of the mobile payment. With reference to FIG. 1, this validation 130 can be received from the mobile device 108 that received the validation from the validation server 106 over the network 112. Alternatively or in addition, the validation 130 can be received over the network 110 and into the wagering game machine 102. Once the validation is complete to ensure that funds are available, the operations of the flowchart 700 continue at block 708.

At block 708, the mobile payment receiver 120 receives, into the wagering game machine, the mobile payment from the mobile device. With reference to FIG. 1, after validation is complete, the mobile payment receiver 120 receives the mobile payment 131 from the mobile device 108. The operations of the flowchart 700 continue at block 710.

At block 710, the mobile payment receiver 120 transmits a mobile payment to a bill validator within the wagering game machine, in response to receiving the mobile payment from the mobile device. With reference to FIG. 1, after receipt of the mobile payment 130, the mobile payment receiver 120 forwards the mobile payment to the bill validation module 119 in the bill validator 114. The operations of the flowchart 700 continue at block 712.

At block 712, the bill validator transmits a credit communication to issue wagering game credit for the wagering game machine in response to receiving the mobile payment. With reference to FIG. 1, the bill validation module 119 in the bill validator 114 transmits the communication 133 to the wagering game module 123 executing on the central processing unit 122. The wagering game module 123 transmits the communication 134 to the credit meter 121. The operations of the flowchart 700 continue at block 714.

At block 714, the credit meter 121 issues the wagering game credit for wagering game play on the wagering game machine in response to the communication. With reference to FIG. 1, the credit meter 121 issues wagering game credit equaling a monetary value of the mobile payment 131 in response to receiving the communication 134. The operations of the flowchart 700 continue at block 716.

At block 716, the wagering game module 123 outputs, from the wagering game machine over a network to a backend server, a payment tracking communication that indicates that the wagering game credit was issued based on the mobile payment received from the mobile device. With reference to FIG. 1, the wagering game module 123 outputs the communication 133 over the network 110 to the backend server 104. The payment tracking module 124 executing therein receives and updates the mobile payments database 126 based on the communication 133. The operations of the flowchart 700 continue at block 718.

At block 718, the wagering game module 123 presents a wagering game on which monetary value can be wagered to a wagering game player, based on the wagering game credit. In particular, the wagering game player can now use the wagering game credits for wagering game play on the wagering game machine 102 based on the monetary value of the mobile payment 131. The operations of the flowchart 700 are complete.

An example set of operations for incorporation of mobile credits into a wagering game machine are now described. In particular, FIG. 8 depicts a flowchart for mobile credit integration into a wagering game system with a wagering game machine, according to some example embodiments. In this example, operations of a flowchart 800 are performed by different components of the wagering game machine 402 of FIG. 4. The operations of the flowchart 800 begin at block 802.

At block 802, the ticket module 484 receives, into a ticket printer of a wagering game machine, a first instruction to cash out a first number of wagering game credits from a credit meter of the wagering game machine through issuance of a printed ticket that denotes the first number of wagering game credits. With reference to FIG. 4, this first instruction can be based on a wagering game player selecting an input (e.g., a button selection) to perform the cash out. In particular, the wagering game player can select a button to perform the cash out that causes a printing of a ticket representing a monetary value of the cash out value. In response, the credit meter 421 can transmit the cash out request to the wagering game machine 423. The wagering game module 423 can forward the request to the ticket printer 483. The operations of the flowchart 800 continue at block 804.

At block 804, the ticket printer 483 outputs the printed ticket, in response to the first instruction. With reference to FIG. 4, in response to receiving this first instruction, the ticket module 484 can cause the printer 485 to receive one of the tickets 486 and to print a monetary value thereon (e.g., a bar code) and to output the ticket (shown as a ticket 487) from the wagering game machine 402 to a wagering game player 490. The operations of the flowchart 800 continue at block 806.

At block 806, the ticket module 484 receives, into the ticket printer of the wagering game machine, a second instruction to cash out a second number of wagering game credits from the credit meter of the wagering game machine through a mobile credit to a mobile device. In particular, instead of outputting a printed ticket, the ticket printer 483 causes the cash out to be transmitted to the mobile device 408 as a mobile credit. A wagering game player can elect to cash out their remaining wagering game credits to the mobile device. The wagering game player can make this election of cash out to a mobile device based using a button selection based on a display of choices on the display of the wagering game machine (see description in reference to FIG. 4 above). The operations of the flowchart 800 continue at block 808.

At block 808, the ticket module 484 transmits, from the ticket printer to a transmitter, a communication to cash out using the mobile credit to the mobile device, in response to the second instruction. In particular, in response to a mobile credit cash out, the credit meter 421 transmits the communication 434 to the wagering game module 423 to issue the credit to the mobile device. The wagering game module 423 transmits the communication 431 to cash out to the mobile device to the ticket printer 483. In response, the ticket module 484 forwards the communication 431 to the mobile credit transmitter 482. The communication can include the monetary value of the cash out. The operations of the flowchart 800 continue at block 810.

At block 810, the mobile credit transmitter 482 transmits to the mobile device, a mobile credit communication that causes the mobile device to be credited with a monetary value equal to the second number of wagering game credits. In particular, the mobile credit transmitter 482 transmits the mobile credit communication 477 to the mobile device 408. The operations of the flowchart 800 are complete.

Operating Environment

This section describes an example operating environment and presents structural aspects of some embodiments. This section includes discussion about wagering game machine architectures and wagering game networks.

Wagering Game Machine Architectures

Figure 9:
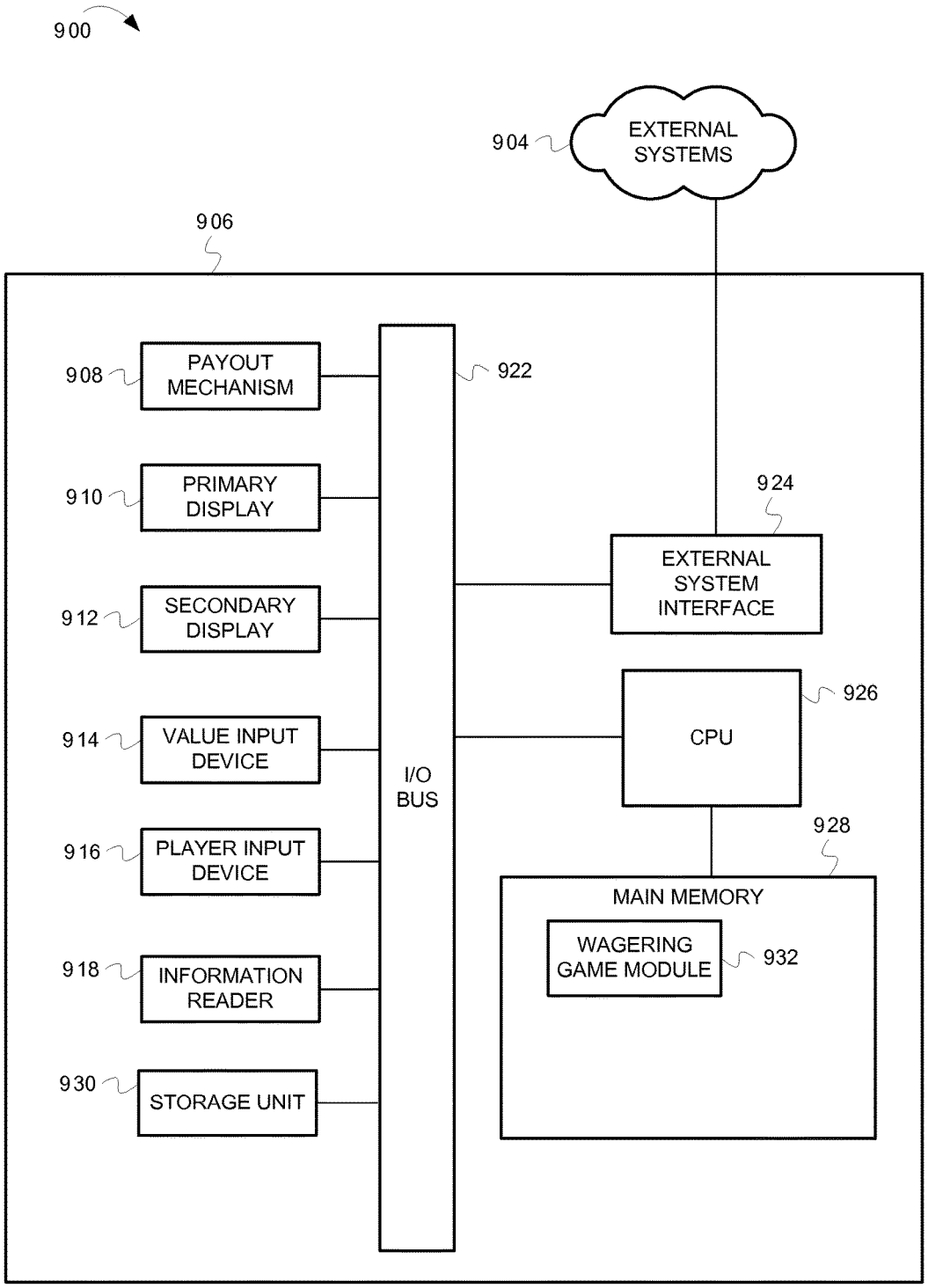
FIG. 9 depicts a block diagram illustrating a wagering game machine architecture, according to some example embodiments.

FIG. 9 depicts a block diagram illustrating a wagering game machine architecture, according to some example embodiments. As shown in FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game module 932. In some example embodiments, the wagering game module 932 can present wagering games, such as video poker, video black jack, video slots, video lottery, etc., in whole or part. The wagering game module 932 can also perform the operations related to mobile payments and credits as described above. While described such that a same module performs these different operations, in some other example embodiments, different modules perform the different operations (e.g., module A presents the wagering games and module B performs the operations related to the mobile payments and credits).

The CPU 926 is also connected to an input/output (I/O) bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems 904 (e.g., wagering game networks).

In one embodiment, the wagering game machine 906 can include additional peripheral devices and/or more than one of each component shown in FIG. 9. For example, in one embodiment, the wagering game machine 906 can include multiple external system interfaces 924 and/or multiple CPUs 926. In one embodiment, any of the components can be integrated or subdivided.

Any component of the architecture 900 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 9 describes an example wagering game machine architecture, this section continues with a discussion wagering game networks.

Wagering Game Networks

Figure 10:
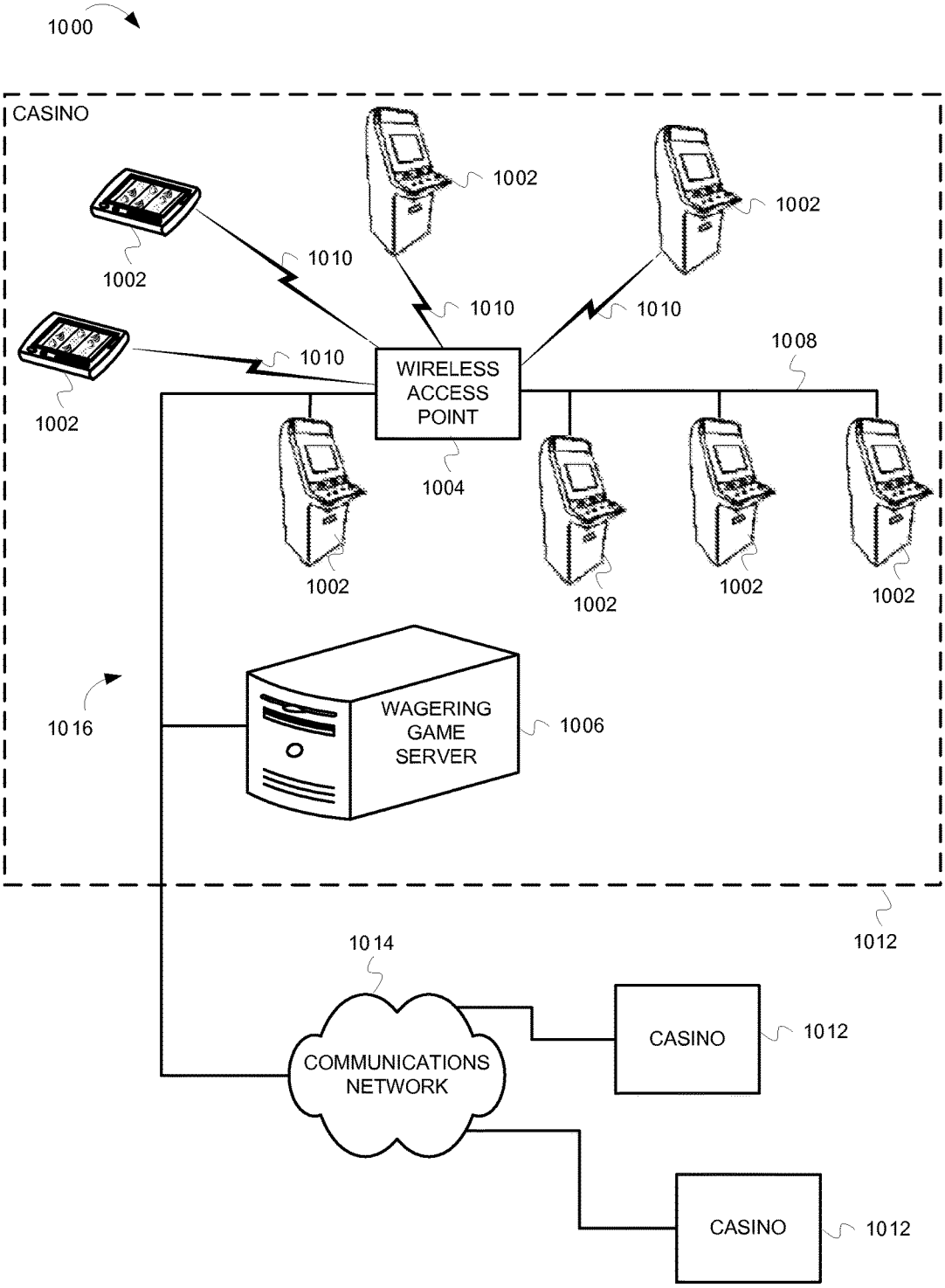
FIG. 10 is a block diagram illustrating a wagering game network, according to some example embodiments.

FIG. 10 is a block diagram illustrating a wagering game network, according to some example embodiments. As shown in FIG. 10, the wagering game network 1000 includes a plurality of casinos 1012 connected to a communications network 1014.

Each casino 1012 includes a local area network 1016, which includes an access point 1004, a wagering game server 1006, and wagering game machines 1002. The access point 10304 provides wireless communication links 1010 and wired communication links 1008. The wired and wireless communication links can employ any suitable connection technology, such as Bluetooth, 802.11, Ethernet, public switched telephone networks, SONET, etc. In some embodiments, the wagering game server 1006 can serve wagering games and distribute content to devices located in other casinos 1012 or at other locations on the communications network 1014. In some example embodiments, the wagering game server 1006 is representative of the backend servers illustrated in FIGS. 1-6.

The wagering game machines 1002 described herein can take any suitable form, such as floor standing models, handheld mobile units, bartop models, workstation-type console models, etc. Further, the wagering game machines 1002 can be primarily dedicated for use in conducting wagering games, or can include non-dedicated devices, such as mobile phones, personal digital assistants, personal computers, etc. In one embodiment, the wagering game network 1000 can include other network devices, such as accounting servers, wide area progressive servers, player tracking servers, and/or other devices suitable for use in connection with embodiments of the invention.

In some embodiments, wagering game machines 1002 and wagering game servers 1006 work together such that a wagering game machine 1002 can be operated as a thin, thick, or intermediate client. For example, one or more elements of game play may be controlled by the wagering game machine 1002 (client) or the wagering game server 1006 (server). Game play elements can include executable game code, lookup tables, configuration files, game outcome, audio or visual representations of the game, game assets or the like. In a thin-client example, the wagering game server 1006 can perform functions such as determining game outcome or managing assets, while the wagering game machine 1002 can present a graphical representation of such outcome or asset modification to the user (e.g., player). In a thick-client example, the wagering game machines 1002 can determine game outcomes and communicate the outcomes to the wagering game server 1006 for recording or managing a player's account.

In some embodiments, either the wagering game machines 1002 (client) or the wagering game server 1006 can provide functionality that is not directly related to game play. For example, account transactions and account rules may be managed centrally (e.g., by the wagering game server 1006) or locally (e.g., by the wagering game machine 1002). Other functionality not directly related to game play may include power management, presentation of advertising, software or firmware updates, system quality or security checks, etc.

Any of the wagering game network components (e.g., the wagering game machines 1002) can include hardware and machine-readable media including instructions for performing the operations described herein.

Example Wagering Game Machine

Figure 11:
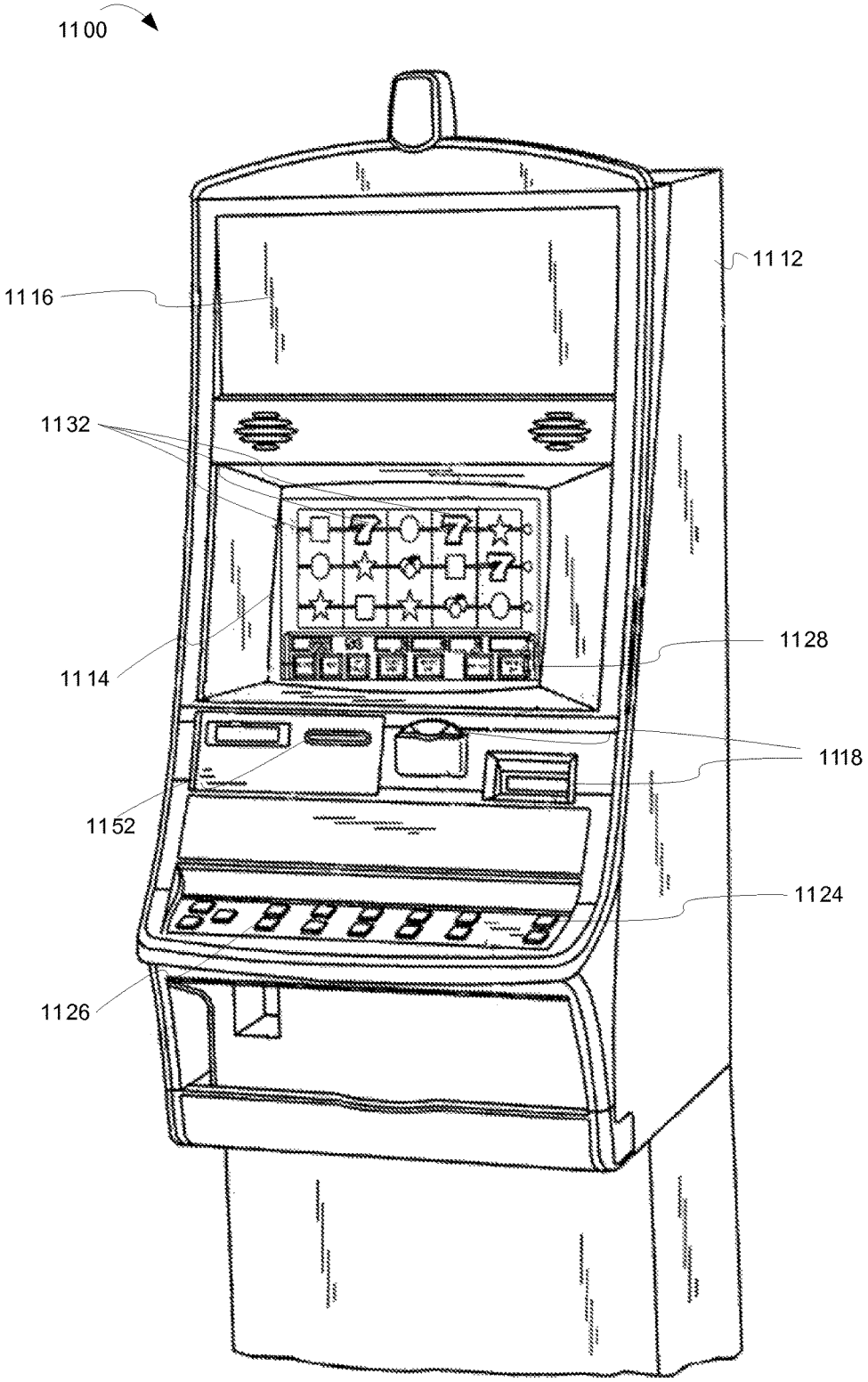
FIG. 11 is a perspective view of a wagering game machine, according to some example embodiments.

FIG. 11 is a perspective view of a wagering game machine, according to some example embodiments. Referring to FIG. 11, a wagering game machine 1100 is used in gaming establishments, such as casinos. According to embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bartop model, mobile handheld model, or workstation console model.

A player begins playing a basic wagering game by making a wager via the value input device 1118. The player can initiate play by using the player input device's buttons or touch screen 1128. The basic game can include arranging a plurality of symbols along a payline 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A wagering game machine comprising:

a processor;

a wagering game module, executable on the processor, configured to present a wagering game on which monetary value can be wagered to a wagering game player;

a receiver configured to communicate with a transmitter of a mobile device to receive a mobile payment from the mobile device;

a bill validator that is communicatively coupled to the receiver, the bill validator configured to receive the mobile payment from the receiver, wherein the bill validator is configured to output a first communication to issue a first wagering game credit for the wagering game machine in response to receipt of a monetary bill, wherein in response to receipt of the mobile payment from the receiver the bill validator is configured to output a second communication to issue a second wagering game credit on the wagering game machine;

wherein in response to receipt of the mobile payment, the receiver transmits to the bill validator a spoofing signal to cause the bill validator to assume that the bill validator had physically received an actual monetary bill or actual printed ticket instead of the mobile payment.

2. The wagering game machine of claim 1, wherein a validation of the mobile payment is to occur prior to being received by the receiver, wherein the receiver is configured to receive a request for the validation, the receiver configured to forward the request for validation to a validation server over a network that is communicatively coupled to the wagering game machine.

3. The wagering game machine of claim 1, wherein the wagering game module is further configured to output, over a network to a backend server, a tracking communication that indicates that the wagering game credit was issued based on the mobile payment received from the mobile device, the tracking communication based on a modified version of a protocol that is used to communicate payment based on receipt of monetary bills and tickets into the wagering game machine, the modified version of the protocol including at least one modification to indicate that the payment was a mobile payment.

4. The wagering game machine of claim 3, wherein the at least one modification includes modifying an existing field in the protocol to indicate that the payment was a mobile payment.

5. The wagering game machine of claim 3, wherein the protocol is at least one of a Slot Accounting System protocol and Game To System Protocol.

6. A computerized method comprising:

communicating, by a receiver in a wagering game machine with a transmitter of a mobile device, to receive a mobile payment from the mobile device;

receiving, from the receiver by a bill validator within the wagering game machine, the mobile payment;

outputting, by the bill validator, a first communication to issue a first wagering game credit for the wagering game machine in response to receipt of a monetary bill;

in response to receiving the mobile payment, transmitting to the bill validator a spoofing signal to cause the bill validator to assume that the bill validator had physically received an actual monetary bill or actual printed ticket instead of the mobile payment; and outputting, by the bill validator, a second communication to issue a second wagering game credit on the wagering game machine in response to receipt of the spoofing signal.

7. The computerized method of claim 6, wherein a validation of the mobile payment is to occur prior to being received by the receiver, wherein the computerized method comprises:

receiving, by the receiver, a request for the validation; and forwarding, by the receiver, the request for validation to a validation server over a network that is communicatively coupled to the wagering game machine.

8. The computerized method of claim 6, further comprising:

outputting over a network to a backend server, a tracking communication that indicates that the wagering game credit was issued based on the mobile payment received from the mobile device, wherein the tracking communication is based on a modified version protocol that is also used to communicate payment based on receipt of monetary bills and tickets into the wagering game machine, the modified version of the protocol including at least one modification to indicate that the payment was a mobile payment.

9. The computerized method of claim 8, wherein the at least one modification includes modifying an existing field in the protocol to indicate that the payment was a mobile payment.

10. The computerized method of claim 9, wherein the protocol is at least one of the Slot Accounting System protocol and Game To System Protocol.

11. One or more non-transitory machine-readable storage media including instructions which, when executed by one or more processors, cause the one or more processors to perform operations comprising:

communicating, by a receiver in a wagering game machine with a transmitter of a mobile device, to receive a mobile payment from the mobile device;

receiving, from the receiver by a bill validator within the wagering game machine, the mobile payment;

outputting, by the bill validator, a first communication to issue a first wagering game credit for the wagering game machine in response to receipt of a monetary bill;

in response to receiving the mobile payment, transmitting to the bill validator a spoofing signal to cause the bill validator to assume that the bill validator had physically received an actual monetary bill or actual printed ticket instead of the mobile payment; and outputting, by the bill validator, a second communication to issue a second wagering game credit on the wagering game machine in response to receipt of the spoofing signal.

12. The one or more non-transitory machine-readable storage media of claim 11, wherein the instructions further cause the one or more processors to perform operations comprising:

outputting over a network to a backend server, a tracking communication that indicates that the wagering game credit was issued based on the mobile payment received from the mobile device, wherein the tracking communication is based on a modified version protocol that is also used to communicate payment based on receipt of monetary bills and tickets into the wagering game machine, the modified version of the protocol including at least one modification to indicate that the payment was a mobile payment.

13. The one or more non-transitory machine-readable storage media of claim 12, wherein the at least one modification includes modifying an existing field in the protocol to indicate that the payment was a mobile payment.

14. The one or more non-transitory machine-readable storage media of claim 13, wherein the protocol is at least one of the Slot Accounting System protocol and Game To System Protocol.

15. The one or more non-transitory machine-readable storage media of claim 11, wherein a validation of the mobile payment is to occur prior to being received by the receiver, wherein the operations comprise:

receiving, by the receiver, a request for the validation; and forwarding, by the receiver, the request for validation to a validation server over a network that is communicatively coupled to the wagering game machine.

* * * * *